US008853542B2

(12) United States Patent
Anderson et al.

(10) Patent No.: US 8,853,542 B2
(45) Date of Patent: Oct. 7, 2014

(54) COLLAR FOR SEALINGLY ENGAGING A COVER FOR CABLE CONNECTORS

(75) Inventors: Cody Anderson, Cicero, NY (US); Noah Montena, Syracuse, NY (US); Christopher P. Natoli, Fulton, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 466 days.

(21) Appl. No.: 13/150,682

(22) Filed: Jun. 1, 2011

(65) Prior Publication Data

US 2011/0230083 A1 Sep. 22, 2011

Related U.S. Application Data

(60) Continuation-in-part of application No. 12/945,525, filed on Nov. 12, 2010, now Pat. No. 8,062,045, and a division of application No. 12/414,255, filed on Mar. 30, 2009, now Pat. No. 7,838,775, and a continuation-in-part of application No. 12/760,134, filed on Apr. 14, 2010, now Pat. No. 8,419,467.

(51) Int. Cl.

| | |
|---|---|
| ***H01R 4/70*** | (2006.01) |
| ***H01R 13/52*** | (2006.01) |
| *H01R 24/40* | (2011.01) |

(52) U.S. Cl.

CPC ..... *H01R 13/5213* (2013.01); *H01R 24/40* (2013.01); *H01R 13/5216* (2013.01)

USPC ..... 174/138 F; 439/521

(58) Field of Classification Search

USPC ..... 439/521, 283; 174/138 F

See application file for complete search history.

(56) References Cited

U.S. PATENT DOCUMENTS

| | | | |
|---|---|---|---|
| 2,755,449 | A | 7/1956 | Anderson |
| 2,881,406 | A | 4/1959 | Arson |
| 2,930,022 | A | 3/1960 | Webster |
| 2,946,839 | A | 7/1960 | Horning |
| 3,120,987 | A | 2/1964 | Degnan et al. |
| 3,251,020 | A | 5/1966 | Coleman |
| 3,390,375 | A | 6/1968 | Salmonson |
| 3,528,051 | A | 9/1970 | Cooper |
| 3,710,307 | A | 1/1973 | Cooper, Jr. |

(Continued)

FOREIGN PATENT DOCUMENTS

| | | |
|---|---|---|
| EP | 0637116 B1 | 1/1995 |
| EP | 0637116 A1 | 2/1995 |

(Continued)

OTHER PUBLICATIONS

U.S. Appl. No. 29/376,585, filed Oct. 8, 2010.

(Continued)

*Primary Examiner* — Michael Zarroli

(74) *Attorney, Agent, or Firm* — Hiscock & Barclay LLP

(57) ABSTRACT

A collar configured to sealingly engage a sealing cover, the collar and the sealing cover configured prevent ingress of environmental elements, comprising a base portion, the base portion including an inner mating surface, a first sleeve portion integrally connected to a base portion, and a second sleeve portion integrally connected to the base portion, wherein a cavity between the first sleeve portion and the second sleeve portion is configured to accept a portion of the sealing cover, wherein the portion of the sealing cover disposed within the cavity sealingly contacts the first sleeve portion and the second sleeve portion is provided. A collar having an interlocking feature is further provided. An associated method is also provided.

17 Claims, 19 Drawing Sheets

(56) References Cited

U.S. PATENT DOCUMENTS

| | | | |
|---|---|---|---|
| 3,713,077 | A | 1/1973 | Leonard |
| 3,753,192 | A | 8/1973 | Urani |
| 3,792,415 | A | 2/1974 | Fuller |
| 3,861,777 | A | 1/1975 | Clark |
| 4,173,385 | A | 11/1979 | Fenn et al. |
| 4,192,566 | A | 3/1980 | Laudig et al. |
| 4,224,464 | A | 9/1980 | Bunnell et al. |
| 4,283,597 | A | 8/1981 | Cooper, Jr. |
| 4,325,600 | A | 4/1982 | Nestor |
| 4,421,369 | A | 12/1983 | Myking |
| 4,593,962 | A | 6/1986 | Knorreck et al. |
| 4,614,392 | A | 9/1986 | Moore |
| 4,647,135 | A | 3/1987 | Reinhardt |
| 4,822,293 | A | 4/1989 | Robson |
| 4,869,679 | A | 9/1989 | Szegda |
| 4,915,990 | A | 4/1990 | Chang |
| 4,985,002 | A | 1/1991 | Maisch et al. |
| 4,998,894 | A | 3/1991 | Gronvall |
| 5,132,495 | A | 7/1992 | Ewing et al. |
| 5,299,951 | A | 4/1994 | Blaetz |
| 5,502,280 | A | 3/1996 | Rocci et al. |
| 5,564,951 | A | 10/1996 | Attal et al. |
| 5,816,853 | A | 10/1998 | Buekers et al. |
| 5,844,171 | A | 12/1998 | Fitzgerald |
| 5,857,865 | A | 1/1999 | Shimirak et al. |
| 5,857,873 | A | 1/1999 | Castaldo |
| 5,886,294 | A | 3/1999 | Scrimpshire et al. |
| 6,007,378 | A | 12/1999 | Oeth |
| 6,109,945 | A | 8/2000 | Creelle et al. |
| 6,162,087 | A | 12/2000 | Hiura |
| 6,203,354 | B1 | 3/2001 | Kuwahara et al. |
| 6,273,733 | B1 | 8/2001 | Uchiyama |
| 6,305,945 | B1 | 10/2001 | Vance |
| 6,336,821 | B1 | 1/2002 | Hattori |
| 6,558,180 | B2 | 5/2003 | Nishimoto |
| 6,887,105 | B2 | 5/2005 | Knighten et al. |
| 6,929,265 | B2 | 8/2005 | Holland et al. |
| 6,942,520 | B2 | 9/2005 | Barlian et al. |
| 7,001,202 | B2 | 2/2006 | Robbins |
| 7,056,151 | B2 | 6/2006 | Cawood et al. |
| 7,179,100 | B2 | 2/2007 | Montena |
| 7,186,127 | B2 | 3/2007 | Montena |
| 7,195,505 | B1 | 3/2007 | Becker |
| 7,216,426 | B2 | 5/2007 | Borgstrom et al. |
| 7,402,063 | B2 | 7/2008 | Montena |
| 7,407,412 | B2 | 8/2008 | Khemakhem |
| 7,731,512 | B1 | 6/2010 | Montena et al. |
| 7,838,775 | B2 | 11/2010 | Montena |
| D631,848 | S | 2/2011 | Montena et al. |
| D642,538 | S | 8/2011 | Montena et al. |
| D642,988 | S | 8/2011 | Montena et al. |
| D642,989 | S | 8/2011 | Montena et al. |
| D642,990 | S | 8/2011 | Montena et al. |
| D643,372 | S | 8/2011 | Montena et al. |
| D646,227 | S | 10/2011 | Natoli |
| 8,062,045 | B2 | 11/2011 | Montena |
| D656,101 | S | 3/2012 | Montena et al. |
| D659,102 | S | 5/2012 | Natoli |
| D664,100 | S | 7/2012 | Montena et al. |
| 2004/0245730 | A1 | 12/2004 | Holland et al. |
| 2006/0035508 | A1 | 2/2006 | Stekelenburg |
| 2006/0286862 | A1 | 12/2006 | Lubinsky et al. |
| 2011/0256755 | A1 | 10/2011 | Montena |
| 2012/0009830 | A1 | 1/2012 | Montena |
| 2012/0190234 | A1 | 7/2012 | Montena et al. |
| 2012/0214335 | A1 | 8/2012 | Natoli et al. |

FOREIGN PATENT DOCUMENTS

| | | | |
|---|---|---|---|
| EP | 0872915 | A3 | 9/1998 |
| EP | 0872915 | A2 | 10/1998 |
| EP | 1249897 | A1 | 10/2002 |
| EP | 1249897 | B1 | 1/2007 |
| GB | 2019665 | A | 10/1979 |

OTHER PUBLICATIONS

U.S. Appl. No. 29/381,622, filed Dec. 21, 2010.

U.S. Appl. No. 29/376,066, filed Oct. 1, 2010.

U.S. Appl. No. 29/376,068, filed Oct. 1, 2010.

U.S. Appl. No. 29/387,881, filed Mar. 19, 2011.

Office Action (Mail Date Dec. 15, 2011) for U.S. Appl. No. 12/760,134, filed Apr. 4, 2010.

CIP U.S. Appl. No. 13/401,835, filed Feb. 21, 2012.

371 U.S. Appl. No. 13/248,789, filed Sep. 29, 2011.

EP10182355 Extended European Search Report. Date of Completion Dec. 6, 2010. 9 pp.

PCT/US2010/050708 filed Sep. 29, 2010; International Search Report and Written Opinion. Date of Mailing: Jun. 29, 2011. 11 pp.

Office Action (Mail Date Aug. 20, 2012) for U.S. Appl. No. 12/760,134, filed Apr. 4, 2010.

Final Office Action (Mail Date Apr. 25, 2012) for U.S. Appl. No. 12/760,134, filed Apr. 4, 2010.

Office Action Restriction Requirement (Mail Date: Aug. 7, 2012) for Cont. U.S. Appl. No. 13/248,789, filed Sep. 29, 2011.

COLLAR FOR SEALINGLY ENGAGING A COVER FOR CABLE CONNECTORS

CROSS-REFERENCE TO RELATED APPLICATIONS

This application is a continuation-in-part claiming priority to U.S. patent application Ser. No. 12/945,525 filed Nov. 12, 2010, entitled "Cover for Cable Connectors," the entirety of which is hereby incorporated by reference, which is a divisional application of U.S. patent application Ser. No. 12/414,255 filed Mar. 30, 2009, now U.S. Pat. No. 7,838,775 issued on Nov. 23, 2010. Moreover, this application is a continuation-in-part claiming priority to U.S. patent application Ser. No. 12/760,134 filed Apr. 14, 2010, entitled "Cover for Cable Connectors," the entirety of which is hereby incorporated by reference.

FIELD OF THE TECHNOLOGY

The following relates to covers for cable connectors, and, more specifically, to covers that protect cable connectors from environmental degradation.

BACKGROUND

Transmission line components such as connectors are often exposed to the open environment and are thus susceptible to degradation from weather related corrosive effects (e.g., moisture infiltration), pollution, debris and other elements. Degradation of the components potentially leads to degradation of the signal quality being transmitted through the cables.

To protect the components from environmental effects, layers of tape have been used to cover and seal the components, creating what have conventionally been referred to as tape-wrap seals. The tape layers typically consist of a first layer of electrical tape, followed by a layer of butyl tape, and then followed by another layer of electrical tape. While the layering of tape does in certain instances provide for a secure seal, it is not without its drawbacks.

First, the taping requires significant time in its initial installation, and needs to be removed in order to gain access to the component when servicing the components (and then reapplied after servicing is complete). The time associated with the taping and removal thereof when servicing the components is costly. In addition, the quality of the seal depends on the skill of the worker that is applying the tape. As such, inconsistent application of the tape may lead to instances of ineffective sealing of components.

Second, the properties inherent in the material composition of the tape subject the tape to size fluctuation and inconsistent adherence. If the tape contracts in colder temperatures and loses adherence strength in warmer temperatures, for example, the quality of the seal created through the tape becomes compromised in regions that experience wide temperature fluctuation. In addition, the same pollutants/contaminants and other environmental factors/elements that affect the components when unsealed may also affect the sealing quality of the tape.

In addition to taping as a sealing provision, plastic clamshell or valise type covers have been used to envelop the components. These style covers are exemplified by the plastic material composition and the closure mechanisms used to open and close them around the components. While the opening and closing of the clamshell style cover facilitates quicker installation and removal in repair situations, it too is not without its drawbacks. For instance, the plastic material becomes brittle in colder temperatures, and this reduction in ductility increases over time. As the material becomes more brittle, the closure mechanisms lose their effectiveness often breaking or otherwise not reliably performing the closure function for which they were designed. Furthermore, the clamshell style closures include seams that extend essentially the entire periphery of the cover, making the sealing function much more difficult when compared to covers that do not include such long seams between parts. As such, the clamshell style covers lose their sealing effectiveness over time and in climates that routinely experience cold temperatures.

Furthermore, existing collars positioned between a cover and a port can allow moisture migration due to the lack of overlapping portions between the collar and the sealing cover.

Therefore, a need exists for an apparatus and method for a collar providing additional overlapping surface area between the collar and the sealing cover to prevent the ingress of environmental elements.

SUMMARY

A first aspect relates generally to a cover for cable connectors or other components that may be quickly installed and/or removed.

A second aspect relates generally to a cable component cover that protects the cable connectors or other components from the environment.

A third aspect relates generally to a cable component cover that maintains its sealing properties regardless of temperature fluctuations.

A fourth aspect relates generally to a cable connector cover that may be used in conjunction with other cable connector covers of various sizes and/or shapes.

A fifth aspect relates generally to a cover for a connector adapted to terminate a cable, wherein the connector includes a body portion and is adapted to terminate in a bulkhead. The cover comprises an elongated body comprising cable and bulkhead ends, interior and exterior surfaces, and the elongated body extends along a longitudinal axis. The interior surface includes a first region adapted to cover at least a portion of the cable and extends from the cable end to a first shoulder, wherein the first region is of a minimum, first cross-sectional diameter. The interior surface further includes a second region which is adapted to cover at least the connector body portion and which extends from the first shoulder to a second shoulder. The second region has a minimum, second cross-sectional diameter that is greater than the minimum, first cross-sectional diameter. The interior surface further includes a third region which is adapted to cover at least a portion of the connector and which extends from the second shoulder to the bulkhead end. The third region has a minimum, third cross-sectional diameter that is greater than the minimum, second cross-sectional diameter.

A sixth aspect relates generally to a cover for a connector adapted to terminate a cable wherein the exterior surface of the cover includes a first region that extends from the cable end to a third shoulder and includes a plurality of circumferential grooves therein. These circumferential grooves extend less than completely around the circumference of the first region of the exterior surface. The first region has a minimum, fourth cross-sectional diameter. The exterior surface of the cover further includes a second region that extends from the third shoulder to a fourth shoulder and has a minimum, fifth cross-sectional diameter that is less than the minimum, fourth cross-sectional diameter. The exterior surface of the cover further includes and a third region that extends from the fourth shoulder to the bulkhead end. This third region has a minimum, sixth cross-sectional diameter that is greater than the minimum, fifth cross-sectional diameter.

A seventh aspect relates generally to a cover for a connector adapted to terminate a cable, and which covers at least a portion of a second cover and at least a portion of a second connector. The first cover comprises an elongated body comprising cable and connector ends, as well as interior and exterior surfaces. The elongated body extends along a longitudinal axis. The interior surface of the first cover includes a first region which is adapted to cover at least a portion of the cable and which extends from the cable end to a first shoulder. The first region includes a plurality of grooves formed therein, and each of these grooves extends in spaced parallel relation to the others. The interior surface of the first cover includes a second region which is adapted to cover at least a portion of the connector and which extends from the first shoulder to a second shoulder. The interior surface of the first cover also includes a third region adapted to cover at least a portion of the second cover.

An eighth aspect relates generally to an adaptor in removable communication with the cover, wherein a portion of the adaptor is adapted to be positioned between the interior surface of the first cover and an exterior surface of the second cover. The adaptor can comprise internal and external surfaces as well as first connector and second connector ends. The external surface comprises a first region extending from the first connector end to a first shoulder. The first region includes a plurality of grooves formed therein, wherein each of the grooves extends in spaced parallel relation to the others. The external surface further comprises a second region extending from the first shoulder to the second connector end. This second region can comprise a variable cross-sectional diameter that gradually decreases from a maximum diameter at the first shoulder to a minimum diameter at the second connector end.

A ninth aspect relates generally to a system for covering both a first connector adapted to terminate a first cable and a second connector adapted to terminate a second cable. The system comprising a first elongated body comprising cable and bulkhead ends as well as interior and exterior surfaces. The elongated body extends along a longitudinal axis and is adapted to envelop at least a portion of the first connector. The interior surface includes a first region adapted to cover at least a portion of the cable and extends from the cable end to a first shoulder. The first region has a minimum, first cross-sectional diameter. The interior surface includes a second region that is adapted to cover at least the connector body portion and which extends from the first shoulder to a second shoulder. The second region has a minimum, second cross-sectional diameter that is greater than the minimum, first cross-sectional diameter. The interior surface includes a third region that is adapted to cover at least a portion of the connector and which extends from the second shoulder to the bulkhead end. The third region has a minimum, third cross-sectional diameter that is greater than the minimum, second cross-sectional diameter. The exterior surface includes a first region that extends from the cable end to a third shoulder and defines at least one, and in a preferred form a plurality of circumferential grooves therein. In an aspect of the invention, the circumferential grooves extend less than completely around the circumference of the first region of the exterior surface, although they could extend entirely around the circumference. The first region has a minimum, fourth cross-sectional diameter. The exterior surface of the cover includes a second region that extends from the third shoulder to a fourth shoulder. The second region has a minimum, fifth cross-sectional diameter that is less than the minimum, fourth cross-sectional diameter. The exterior surface of the cover includes a third region which extends from the fourth shoulder to the bulkhead end. The third region has a minimum, sixth cross-sectional diameter that is greater than the minimum, fifth cross-sectional diameter. A second elongated body is adapted to telescopically engage the first elongated body in enveloping relation to the second connector. The second elongated body comprises cable and bulkhead ends as well as interior and exterior surfaces, and is adapted to extend co-axially from the first body when engaged therewith. The second elongated body is adapted to envelop at least a portion of the second connector, and a portion of the first elongated body is adapted to be positioned between the interior surface of the second elongated body member and the first connector.

A tenth aspect relates generally to a collar configured to sealingly engage a sealing cover, the collar and the sealing cover configured prevent ingress of environmental elements, comprising a base portion, the base portion including an inner mating surface, a first sleeve portion integrally connected to a base portion, and a second sleeve portion integrally connected to the base portion, wherein a cavity between the first sleeve portion and the second sleeve portion is configured to accept a portion of the sealing cover, wherein the portion of the sealing cover disposed within the cavity sealingly contacts the first sleeve portion and the second sleeve portion.

An eleventh aspect relates generally to a sealing device comprising a collar for sealingly engaging a sealing cover, wherein the collar includes: a first axial surface of the collar configured to overlap a first surface of the sealing cover, a second axial surface of the collar configured to overlap a second surface of the sealing cover, wherein the collar has a general axial opening from a first end to a second end of the collar to fit over an equipment port.

A twelfth aspect relates generally to a collar configured to sealingly engage a sealing cover, the collar and the sealing cover configured to seal a connection between a connector and an equipment port, comprising a base portion, the base portion including an inner mating surface configured to prevent ingress of environmental elements, a first sleeve portion integrally connected to the base portion, wherein the first sleeve portion includes an interlocking feature, a second sleeve portion integrally connected to a base portion, the second sleeve portion spaced a radial distance from the first sleeve portion, and wherein, when a portion of the sealing cover is disposed between the second sleeve portion and the first sleeve portion, the interlocking feature of the first sleeve portion interlocks with at least one corresponding interlocking feature of the sealing cover to indicate a correct sealing position.

A thirteenth aspect relates generally to a method of sealing a coaxial cable connection, comprising providing a collar including a base portion, the base portion including an inner mating surface, an second sleeve portion integrally connected to a base portion; and a first sleeve portion integrally connected to the base portion, wherein a distance between the first sleeve portion and the second sleeve portion define a cavity; disposing the collar over an equipment port and at least one coaxial cable connector component, wherein the inner mating surface of the collar provides a seal between the collar and the equipment port, and inserting an end of a sealing cover within the cavity.

BRIEF DESCRIPTION

The present invention will be more fully understood and appreciated by reading the following Detailed Description in conjunction with the accompanying drawings, in which.

DETAILED DESCRIPTION

Figure 1A:
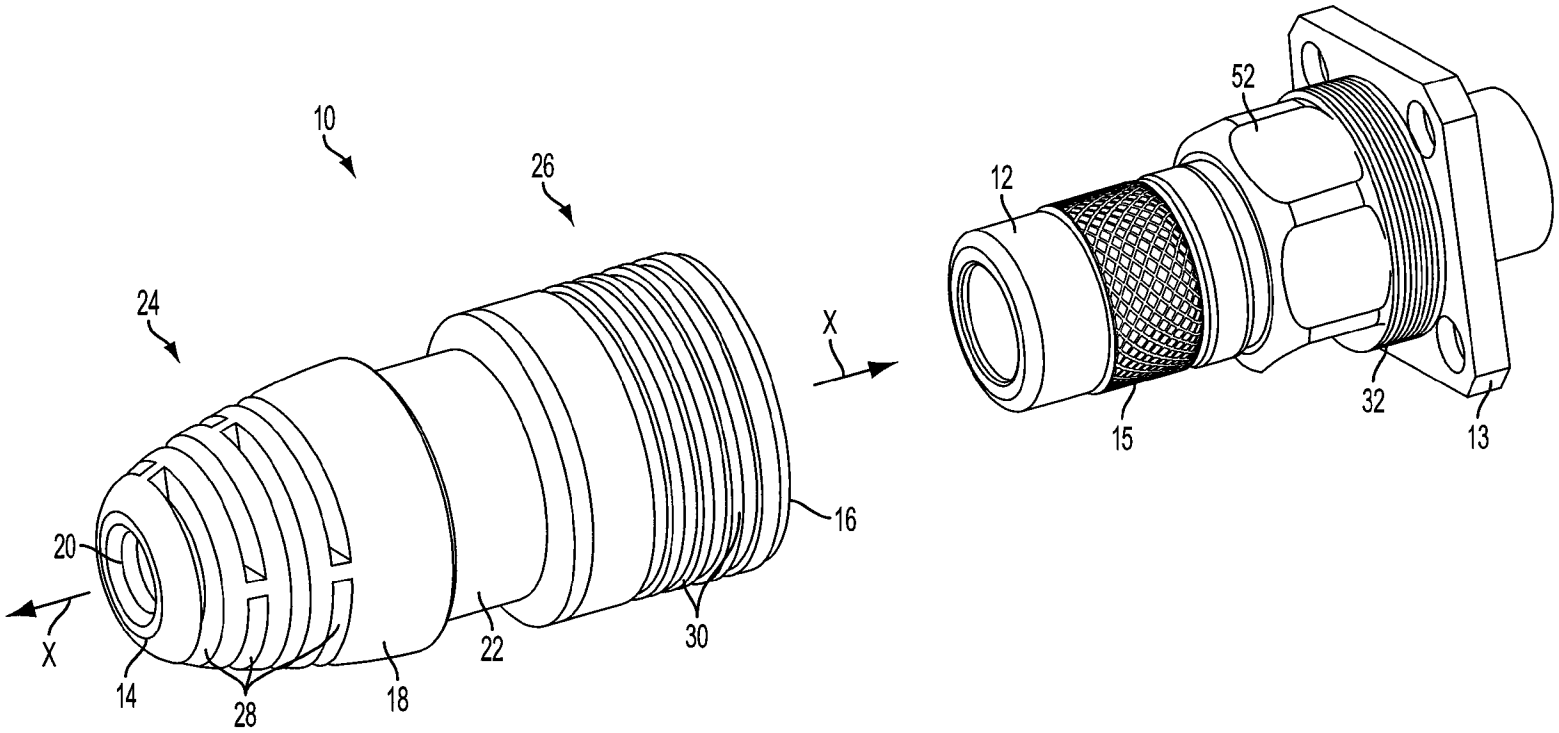
FIG. 1A is an exploded view of a first embodiment of a cover and cable connector assembly.

Referring now to the drawings, wherein like reference numerals refer to like parts throughout, there is seen in FIG. 1A a cover, designated generally by reference numeral 10, adapted to be placed in secure and sealing relation over a connector 12 (such as a 5-series connector manufactured by John Mezzalingua Associates, Inc. of East Syracuse, N.Y. that is adapted to terminate a ⅞" cable). Connector 12 terminates on a bulkhead 13. In the embodiment of FIG. 1A, cover 10 comprises: an elongated body composed of a rubber material that exhibits a low modulus of elasticity over an extended temperature range, preferably a silicone rubber, that extends along a longitudinal axis X-X; a cable end 14; bulkhead end 16; exterior surface 18; interior surface 20; and an annular groove 22 of reduced diameter (when compared to the other sections of cover 10 as defined below) formed at a medial position in exterior surface 18. The rubber composition of the cover 10 permits it to elastically deform to the connector and other elements that it covers (e.g., the bulkhead), as will be described in greater detail hereinafter, when being installed or removed. In addition, the reduced diameter of medial section 22 provides a suitable gripping area for a gripping tool or fingers when installing cover 10 on a connecter 12.

Cover 10 further comprises a cable end region 24 positioned on the cable receiving side of groove 22, and a bulkhead end region 26 positioned on the bulkhead side of groove 22. The cable end region 24 includes a plurality of strain relief grooves 28 formed therein with each groove 28 extending less than entirely around the circumference of exterior surface 18, although it should be noted that a single strain relief may be suitable in a particular application and the groove could extend entirely around the circumference. In one embodiment, two of the grooves are disconnected from one another by a gap between their ends, and are formed around the circumference of exterior surface in a common plane that extends transverse to the longitudinal axis X-X. In one embodiment, cable end region 24 is provided with a plurality of strain relief grooves 28 formed in co-planar pairs around exterior surface 18 and with each pairing extending in laterally spaced, parallel planes to one another.

Grooves 28 serve several purposes. Due to the interference type fit of cover 10 over connecter 12, the material removal required to form grooves 28 facilitates easier stretching of the cover over the connector due to less surface contact, and hence friction, during the covering process. Grooves 28 further permit cover 10 to bend in the areas of grooves 28, thereby providing strain relief when the cable 7 is bent.

Bulkhead end region 26 comprises a series of grooves 30 formed entirely circumferentially around exterior surface 18 in spaced, parallel relation to one another. In this embodiment of the present invention, grooves 30 provide reservoirs in which liquid may collect. In one embodiment, grooves 30 provide pressure points to engage or otherwise frictionally interact with grooves on the inner surface of another cover, as will be described in greater detail hereinafter.

Figure 1B:
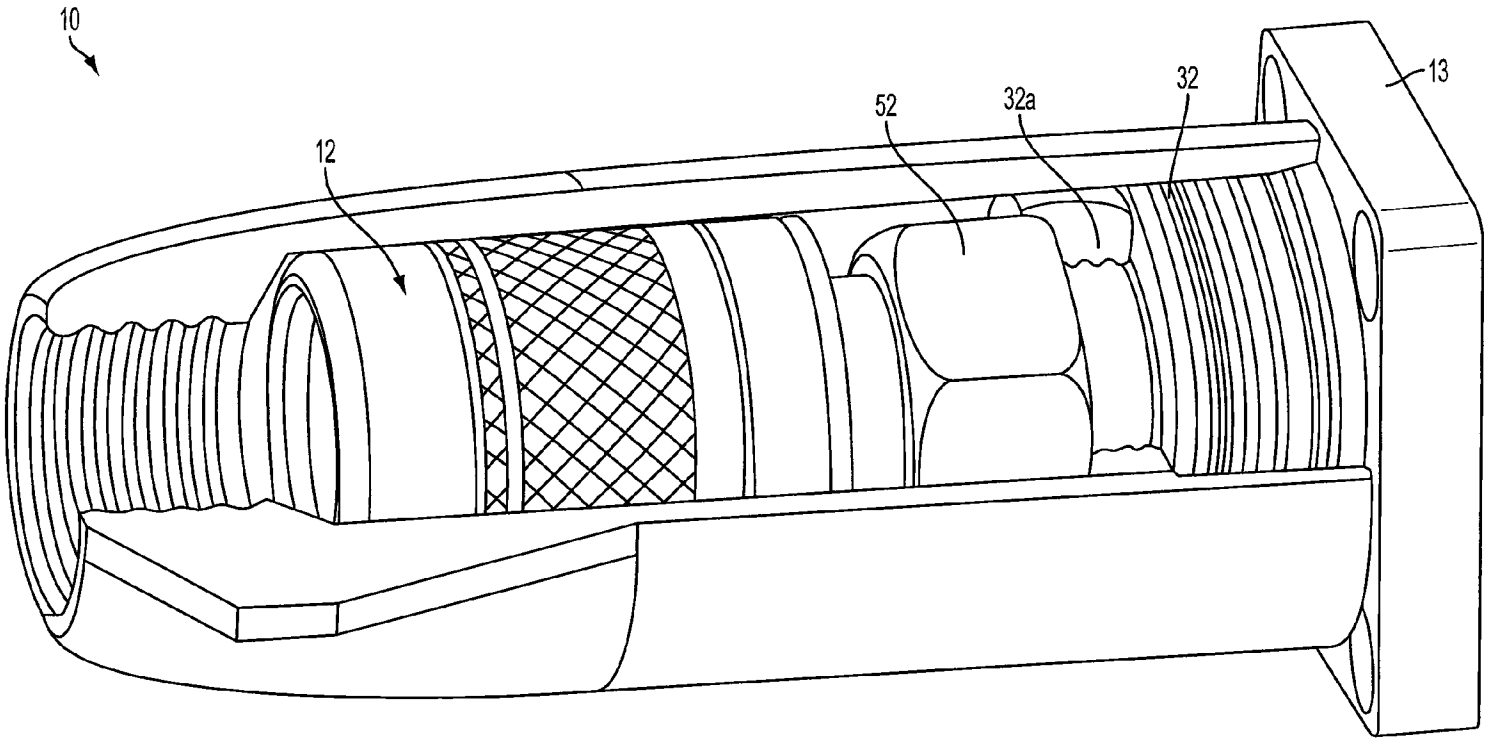
FIG. 1B depicts a perspective partial cut away view of the first embodiment of the cover and cable connector assembly.

As shown in FIG. 1A, connector 12 extends outwardly from bulkhead 13 along axis X-X. Bulkhead 13 includes a shank portion 32, or collar, that is either integral therewith or comprised of a separate element preferably composed of rubber. If shank portion 32 is integral with bulkhead 13, a rubber gasket 32*a* may be placed in sealing relation at the interface of shank portion 32 and the neck of bulkhead 13, as shown in FIG. 1B. The rubber gasket 32*a* may be a collar configured to tightly surround a portion of the connector 12 proximate the coupling element 52. Shank portion 32 is of a diameter having a dimension at least as large as, and preferably larger than the maximum width of coupling element/nut 52 (which is the next widest part of the connector), thus creating the connector's maximum width dimension at the interface of connector 12 and bulkhead 13. The neck 14 of the bulkhead 13 may be a smooth external surface of the bulkhead 13. Embodiments of bulkhead 13 may be an equipment port configured to mate with various types of coaxial cable connectors.

Figure 2:
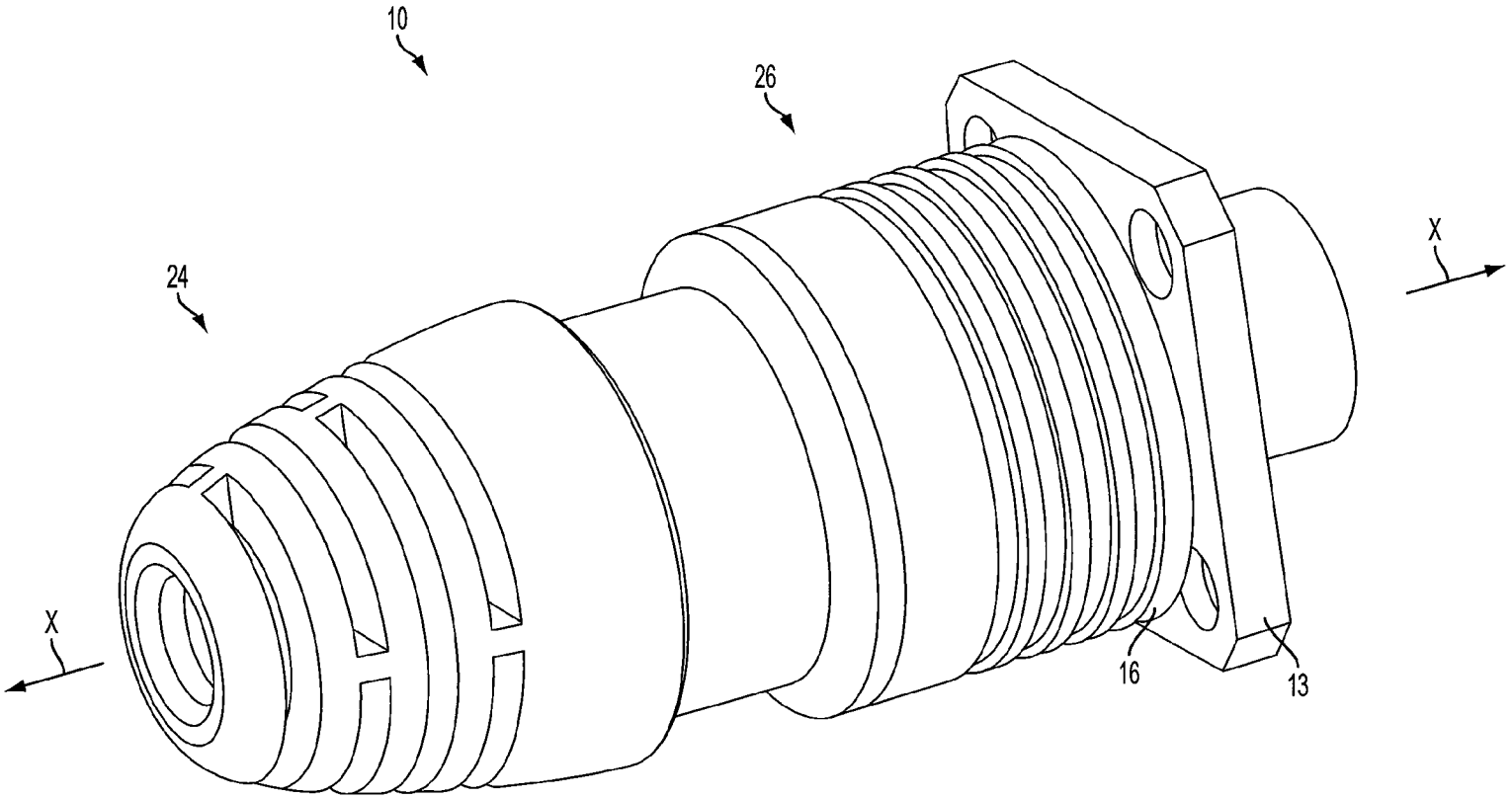
FIG. 2 is a side view of an assembled configuration thereof.

FIG. 2 depicts cover 10 fully assembled onto connector 12. In the assembled configuration, bulkhead end 16 of cover 10 is in reversible communication with bulkhead 13 to provide environmental protection.

Cover 10 (and all embodiments of the cover), and embodiments of the collar 300, 300A, 300B (described in greater detail infra) may be pre-lubricated with a dry lubricant on its inside surface to ease the installation. Impregnating the rubber material composing the covers and collars 300, 300A, 300B at the time of manufacture with an oil/grease composition is also effective in reducing the force required to install a cover over a connector.

Figure 3:
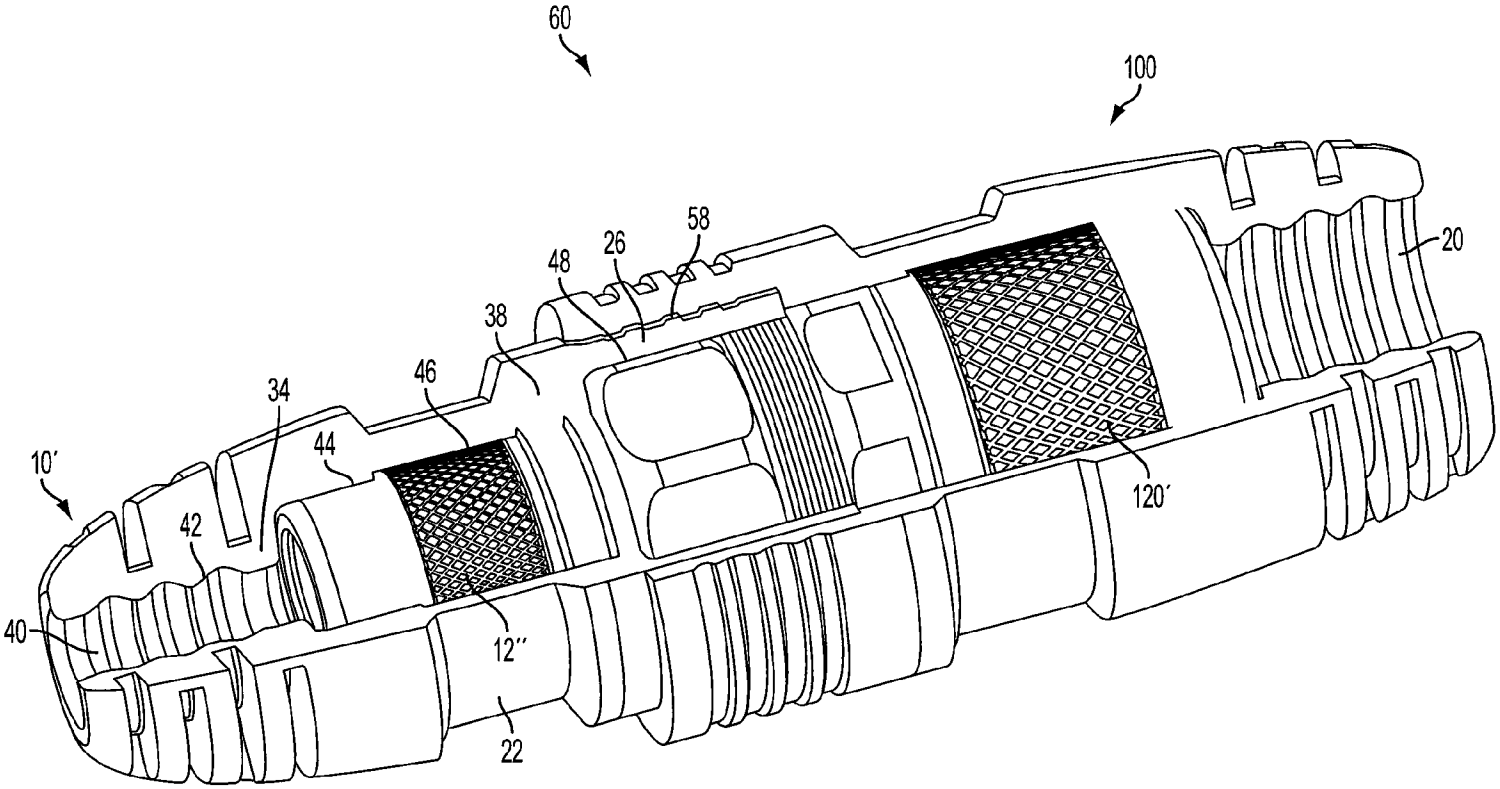
FIGS. 3-5 are partially cut-away perspective views of a second embodiment of a system of covers for providing cover to first and second cable connectors used to splice two differently sized cables.

Referring now to FIG. 3, the interior surface 40 of cover 10 includes a first region 42 that is of a serrated cross-section (and thus of continuously fluctuating diameter) and extends from cable end 14 to a first shoulder 34 from which it steps outwardly to a second region 44 of increased, essentially constant cross-sectional diameter. From this second region 44, the interior transitions outwardly via a step to the medial region's 22 interior diameter 46 where it remains essentially constant until shoulder 38 and then steps outwardly once more to a final internal region 48 that corresponds with bulkhead region 26. Region 48 is of an essentially constant cross-sectional diameter. These distinct regions of respective cross-sectional diameters securely envelop connector 12 and form seals at multiple points along the connector as will be described hereinafter.

In another embodiment, the interior surface 40 of cover 10 includes a first region 42 that extends from cable end 14, as shown in FIG. 1A, to a first interior shoulder 34. This first region has a first cross-section diameter. At shoulder 34, interior surface 40 steps outwardly to a second region 44 having a second, essentially constant cross-sectional diameter. In this embodiment, the second cross-sectional diameter is larger than the first cross-sectional diameter. Looking at FIG. 1A, the first interior region 42 with the first cross-sectional diameter would fit over region 15 of connector 12, and the second interior region 44 with the second cross-sectional diameter would fit over the coupling element/nut 52. These distinct regions of respective cross-sectional diameters securely envelop connector 12 and form seals at multiple points along the connector.

To use cover 10, the cover would first be fully slid (cable end 14 first) over a cable 7 that is to be terminated in connector 12, leaving the terminal end of the cable exposed. As the cover 10 is designed to have an interference fit with the cable 7, it may be useful to apply a small amount of grease to the outside of the cable jacket to assist in pulling the cover over the cable 7 (although the preferred pre-lubricated rubber composition of cover may make such step unnecessary). The cable 7 may then be terminated and attached to connector 12 in a conventional manner. Cover 10 would then be manually slid over connector 12 until its bulkhead end 16 preferably abuts, but at least overlaps with bulkhead 13. When cover 10 is fully positioned over connector 12, first region 24 of cover 10 tightly enwraps the cable 7 with shoulder 34 positioned adjacent the terminating end of connector 12, thereby forming a seal between the cable 7 and cover 10. If moisture does infiltrate the seal formed between the cable 7 and cover 10 (due, for instance, to scratches or other removal of material that often occurs with the cable's jacket), the grooves 50 in first region 24 function as small reservoirs. Medial region 22 extends in tightly covering relation to the majority of connector 12, including its coupling element/nut 52 (although illustrated as a nut, various types of coupling elements are conventionally used on cable connectors of the type herein described) and the interface ring 44 that interfaces connector 12 with bulkhead 13, with a seal being formed at the junction of the interface ring 44 and medial region's 22 interior diameter 46. Shoulder 38 of cover 10 tapers outwardly (although it could be stepped instead of tapered) to accommodate shank portion 32, with internal region 48 adapted to cover the shank portion 32, with seals being formed between shank portion 28 and cover 10.

Figure 4:
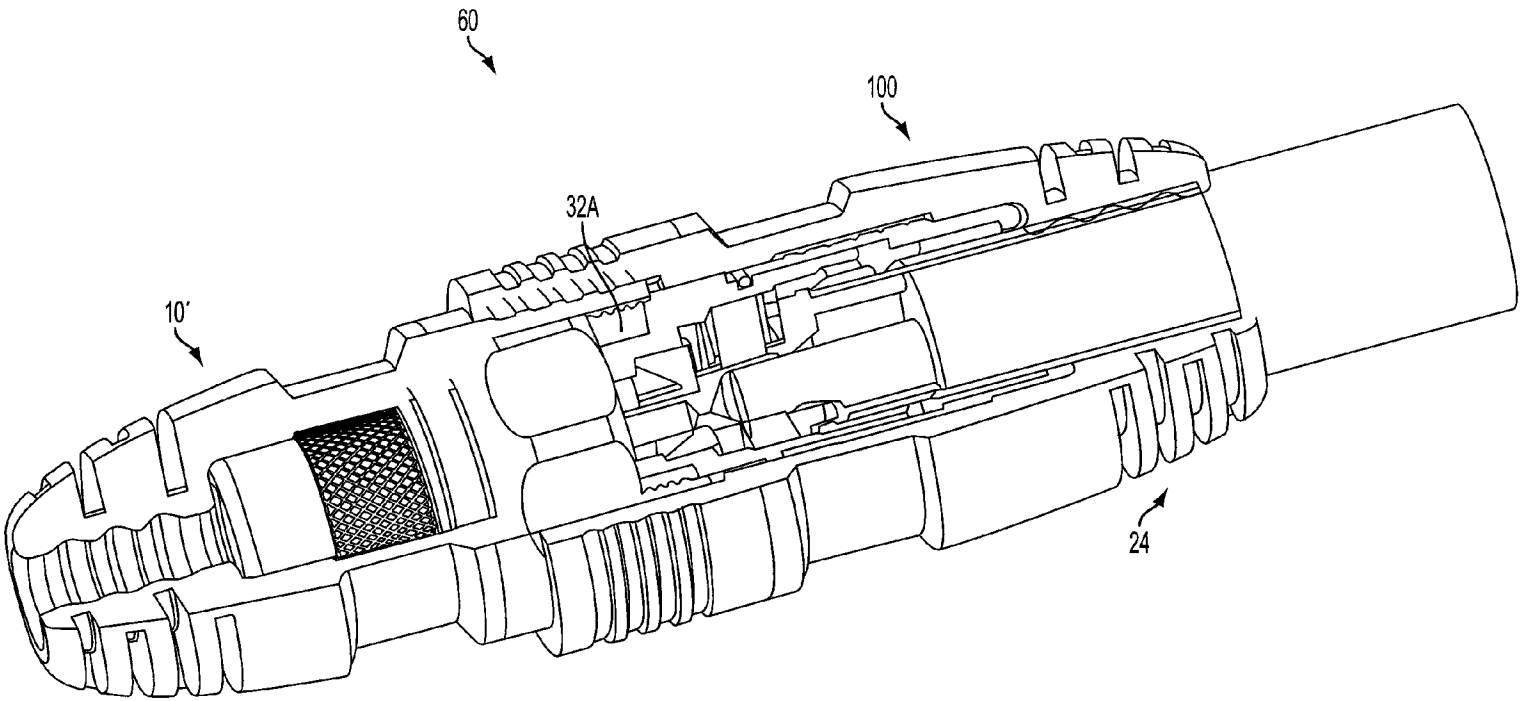
Figure 5:
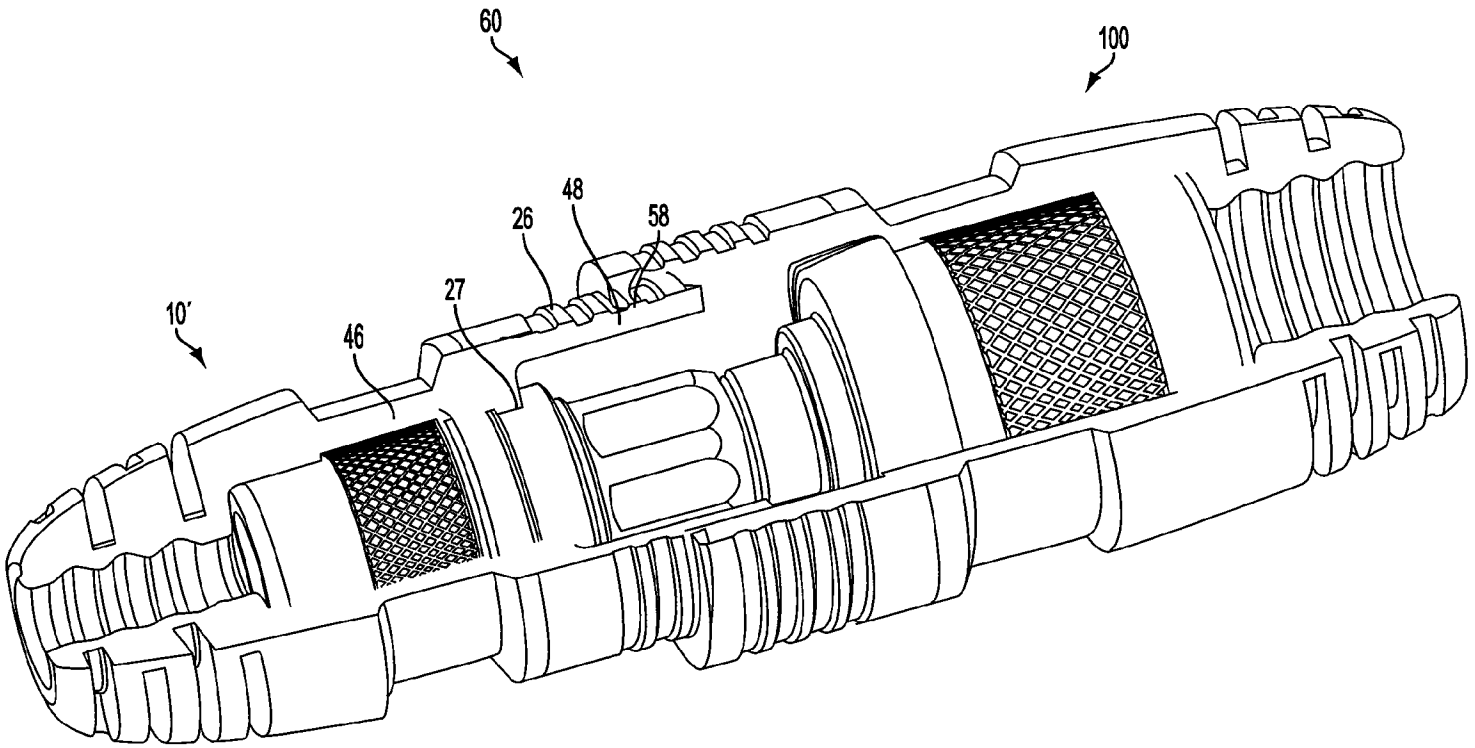

While cover 10 is adapted to be placed in covering relation to connectors that terminate in a bulkhead, with reference to FIGS. 3-5 there is seen a system for covering a pair of connectors that are used to splice together two differently sized cables. FIGS. 3-5 illustrate a system 60 of using covers 10 (which will be designated 10' for purposes of differentiating the bulkhead embodiments from the splice embodiment) and 100 to splice cables that terminate in connectors 12' and 120 (connectors 12' and 120 can be structurally the same as connectors 12 and 102 with the difference being the lack of a bulkhead for terminating the connectors since the connectors are joined together). The structures of covers 10' and 100 are the same as described above for cover 10, but with a different method of use and resultant arrangement.

FIG. 3 depicts covers 10' and 100 in a fully assembled configuration in system 60. In this configuration, the smaller cover 10' protects a smaller connector 12' (such as 4-series connector manufactured by John Mezzalingua Associates, Inc. of East Syracuse, N.Y. that is adapted to terminate a ½" cable) while the larger cover 100 protects a larger connector 120 (such as 5-series connector manufactured by John Mezzalingua Associates, Inc. of East Syracuse, N.Y. that is adapted to terminate a ⅞" cable). To position covers 10' and 100 into the assembled configuration, cover 10' is first slid over connector 12 as described above. Cover 100 is then slid over connector 120. To form a protective seal the internal region 58 of second cover 100, which is optionally of a serrated cross-section (and thus of continuously fluctuating diameter) as shown in FIG. 4, is slid over external region 26 of cover 10'. In addition to forming a protective seal, the interference fit between region 58 of second cover 100 and grooves 30 of region 26 in cover 10' inhibits removal of either cover without the application of force specifically directed toward disassembling the assembly.

Covers 10, 10', or 100 can be adapted to various configurations in order to protect the cable connector. Typically, the configuration of the cover will depend on the shape, size, or other physical characteristics of the connector. For example, in FIG. 3 internal surface 20 of second cover 100 is wider than internal surface 20 of covers 10 or 10' in order to encompass a larger connector or cable. In yet another embodiment shown in FIG. 4, region 24 of cover 100 is elongated to cover an elongated connector. In other embodiments, the cover can be as elongated as is necessary to protect the connector. FIG. 5 shows an assembled configuration in which internal region 58 of second cover 100 does not completely cover external region 26 of cover 10' due to the physical characteristics of the depicted cable connectors. The thickness of material between the external surface of the cover and the internal surfaces such as 42, 46, and 48 can also independently vary between very thin and very thick depending upon design requirements or the needs of the user.

With reference to FIG. 5, as the interior of cover 10' transitions from region 46 to region 48, the cover 10' can optionally include an annular ridge 27 that is of a similar or smaller diameter than internal region 46. During assembly, ridge 27 essentially snaps over the connector, creating yet another tight seal to further protect the cable connectors from moisture and other environmental factors while inhibiting the removal of the cover without the application of force specifically directed toward disassembling the assembly.

Figure 6:
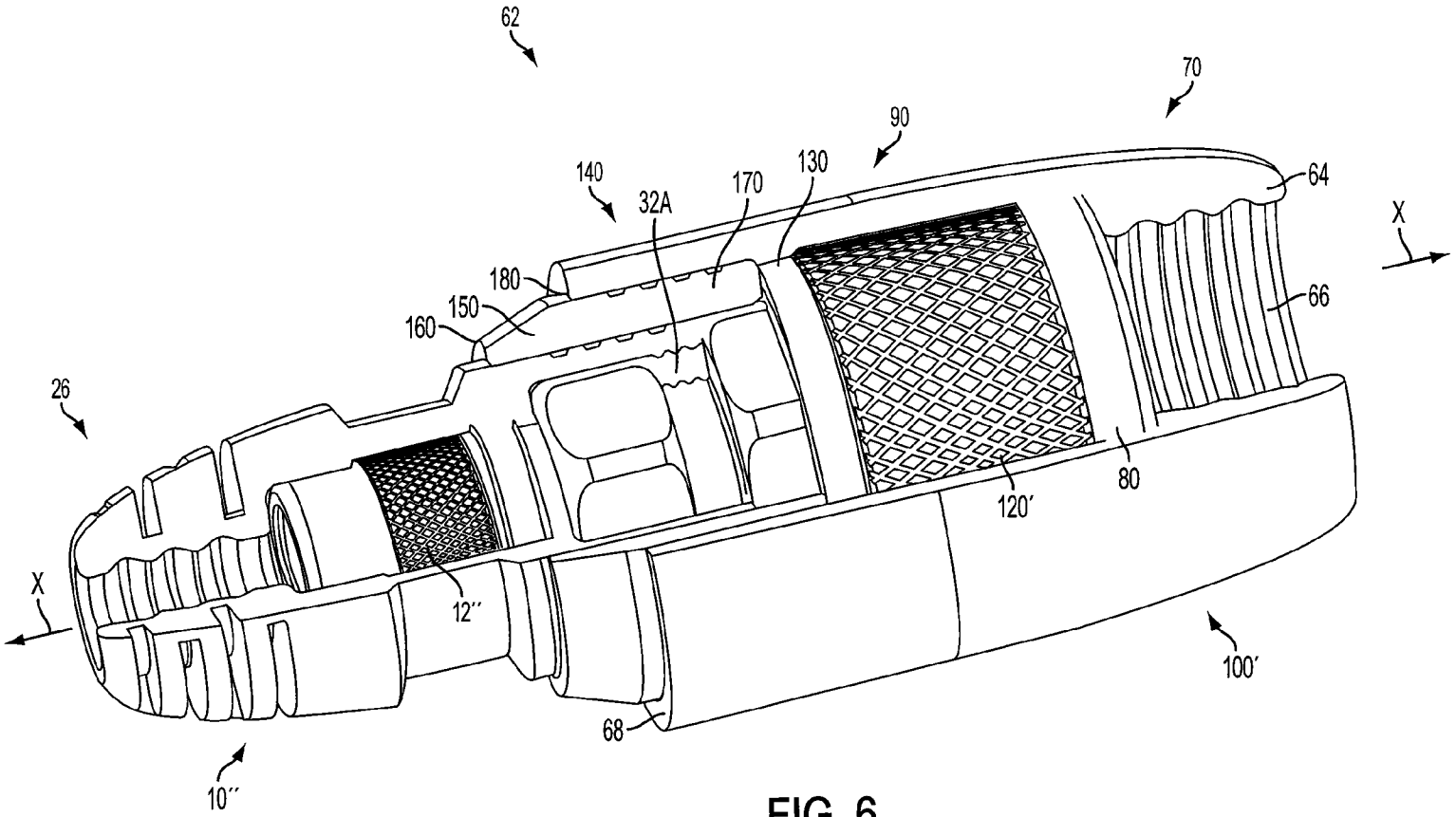
FIG. 6 is a partially cut-away perspective view of a third embodiment of a system of covers for providing cover to first and second cable connectors and using an adaptor.

FIG. 6 depicts another embodiment of the system for covering a pair of connectors that are used to splice together two differently sized cables. In this system 62, covers 10 and 100 (which are designated 10" and 100', respectively for purposes of differentiating the bulkhead embodiments from both the splice embodiment and previous system 60) splice cables that terminate in connectors 12" and 120' (connectors 12" and 120' can be structurally the same as or similar to connectors 12, 12', and 120 with the difference being the lack of a bulkhead for terminating the connectors since the connectors are joined together). The structures of cover 10" is the same as described above for cover 10 and 10', but with a different method of use and resultant arrangement.

In contrast, the structure of cover 100' is different from the structure of the previous covers. Cover 100' is adapted to be placed in secure and sealing relation over a connector (such as a 6-series connector manufactured by John Mezzalingua Associates, Inc. of East Syracuse, N.Y. that is adapted to terminate a 1¼" cable) or another cover. In the embodiment of FIG. 6, cover 100' comprises: an elongated body composed of a rubber material that exhibits a low modulus of elasticity over an extended temperature range, preferably a silicone rubber, that extends along a longitudinal axis X-X; a cable end 64; interior surface 66; and a cable connector end 68. The interior surface 66 of cable end 64 of cover 100' includes a first region 70 that is a serrated cross-section (and thus of continuously fluctuating diameter) and extends from cable end 64 to a first shoulder 80 from which the interior surface steps outwardly to a second region 90 of increased, essentially constant cross-sectional diameter. From this second region 90, the interior transitions inwardly to shoulder 130, thence outwardly to a final region 140. The interior surface of region 140 is of an essentially constant cross-sectional diameter. These distinct regions of respective cross-sectional diameters securely envelop both connector 120' and cover 10" to form seals at multiple points as will be described hereinafter.

FIG. 6 depicts covers 10" and 100' in a fully assembled configuration in system 62. In this configuration, the smaller cover 10" protects a smaller connector 12" (such as 4-series connector manufactured by John Mezzalingua Associates, Inc. of East Syracuse, N.Y. that is adapted to terminate a ½" cable) while the larger cover 100' protects a larger connector 120' (such as 6-series connector manufactured by John Mezzalingua Associates, Inc. of East Syracuse, New York that is adapted to terminate a 1¼" cable). To position covers 10" and 100' into the assembled configuration, cover 10" is first slid over connector 12" as described above. Cover 100' is then slid over connector 120'. To form a protective seal region 140 of second cover 100' is slid over the connector region of cover 10". In addition to forming a protective seal, the interference fit between the interior surface of cover 100' and the grooves 30 of the connector region of cover 10" inhibits removal of either cover without the application of force specifically directed toward disassembling the assembly. Furthermore, having the plurality of grooves 30 provides redundancy in terms of inhibiting moisture migration; if one of the peaks forming grooves 30 is sliced or otherwise compromised, moisture may infiltrate and reside in the valley of that groove (i.e., each valley provides a successive reservoir for moisture containment).

Figure 7A:
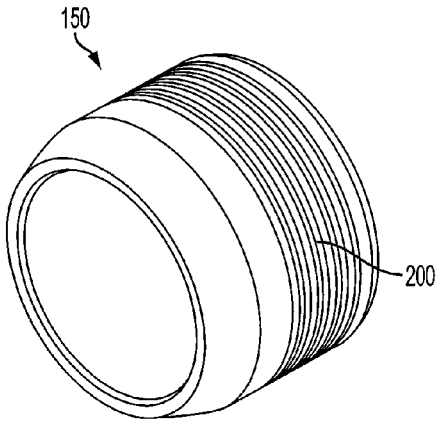
FIG. 7A is a side view of a first embodiment of an adaptor.
Figure 7B:
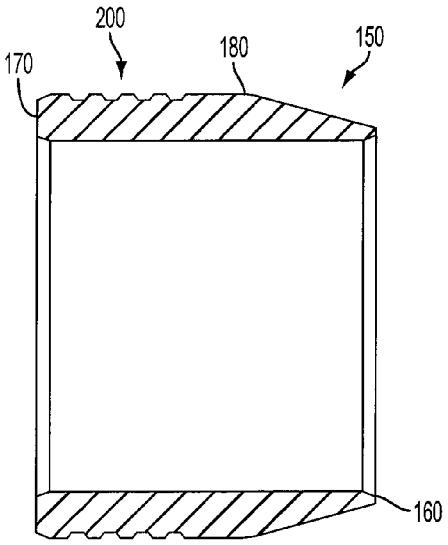
FIG. 7B is a bisecting cut-away view of one embodiment of the adaptor.

FIG. 6 also depicts an adaptor 150 used in conjunction with the cable covers to further protect the cable connectors from prevent moisture and other environmental factors. Specifically, adaptor 150 is used to fill the space left by two covers of non-interfering dimensions. For example, in FIG. 6, the interior diameter of the connector end of cover 100' is greater than the outer diameter of the connector end of cover 10", thereby creating a gap that would allow moisture to directly access the cable connectors. Adaptor 150 is used to fill that gap. As shown more clearly in FIGS. 7A and 7B, adaptor 150 comprises: an elongated body composed of a hard plastic material (e.g., glass filled nylon), although other materials, including metal, could be used, that has a higher modulus of elasticity than the elastomeric rubber material of the covers and that extends along a longitudinal axis X-X; a first end 170; and a second end 160. The exterior surface of the adaptor defines a region 200 which extends from first end 170 to a first shoulder 180. Region 200 is of serrated cross-section (and thus of continuously fluctuating diameter). In one embodiment of the adaptor, the diameter of the exterior surface gradually decreases from a maximum diameter at shoulder 180 to a minimum diameter at second end 160, although many other designs are possible.

To position the covers and adaptor 150 into the assembled configuration shown in FIG. 6, cover 10" is first slid over connector 12" as described above. The adaptor is then fully slid over cover 10", with second end 160 of the adaptor sliding over the connector end of cover 10" (although the adaptor could alternatively be slid onto the cable end of cover 10", with first end 170 of the adaptor sliding onto the cover first). In this configuration, the interference fit between the interior surface of adaptor 150 and the grooves 30 of the connector region of cover 10" inhibits removal of the adaptor without the application of force specifically directed toward disassembling the assembly (the differing material compositions of adapter 150 and any of the covers does facilitate movement with slightly less force than would be required if the adapter was also composed of the same elastomeric material as the covers). Cover 100' is then slid over connector 120'. To form a protective seal, region 140 of second cover 100' is slid over the region 200 of adaptor 150. In addition to forming a protective seal, the interference fit between the interior surface of cover 100' and the serrated exterior surface of region 200 of the adaptor inhibits removal of either cover without the application of force specifically directed toward disassembling the assembly.

Figure 7C:
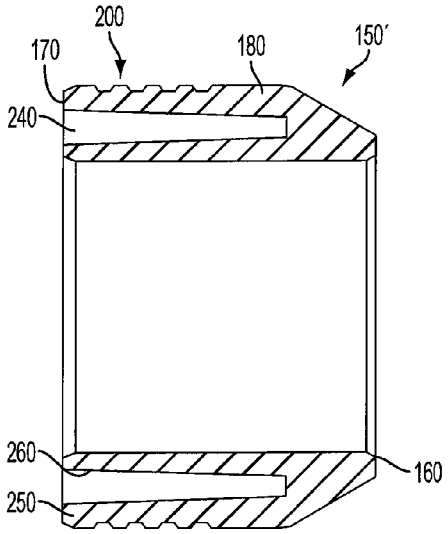
FIG. 7C is a bisecting cut-away view of another embodiment of the adaptor.
Figure 8:
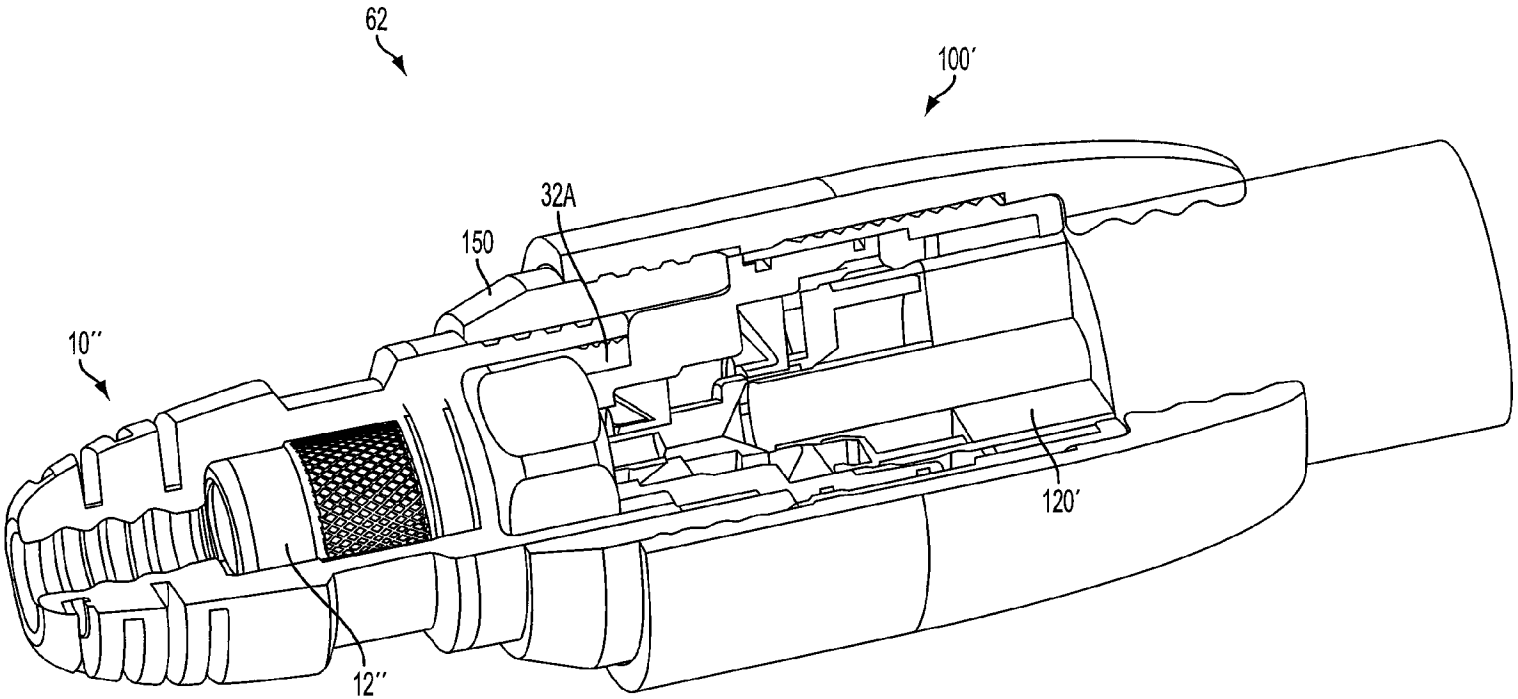
FIG. 8 is a partially cut-away perspective view of a third embodiment of a system of covers for providing cover to first and second cable connectors and using an adaptor.
Figure 9:
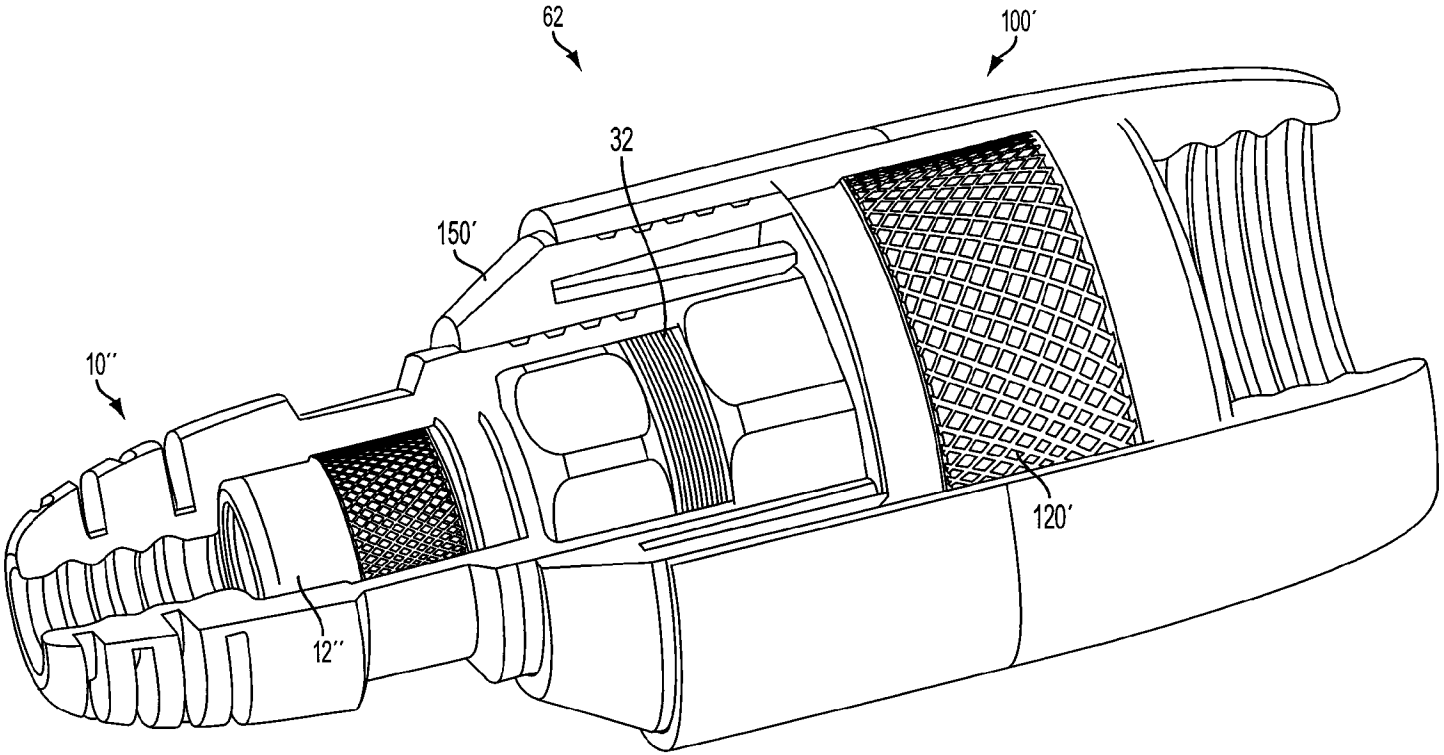
FIGS. 9-11 are partially cut-away perspective views of a fourth embodiment of a system of covers for providing cover to first and second cable connectors and using an adaptor.
Figure 10:
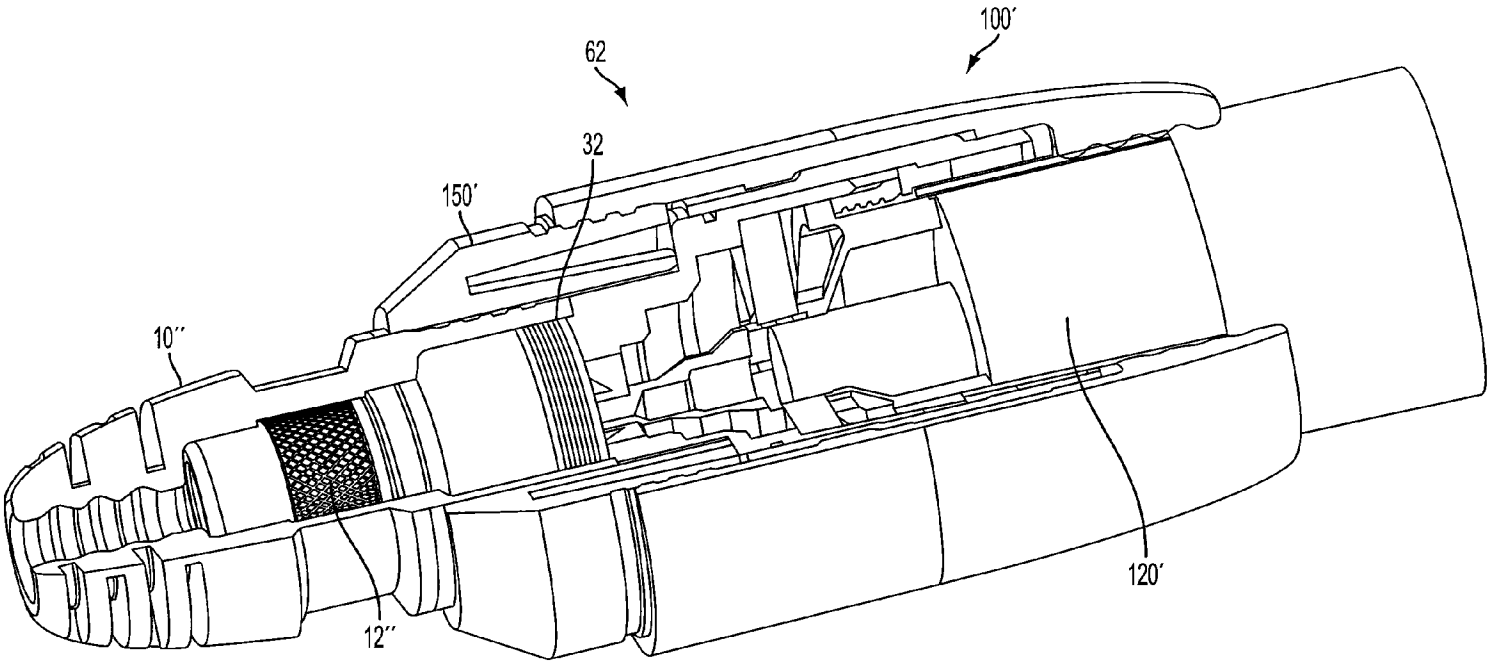
Figure 11:
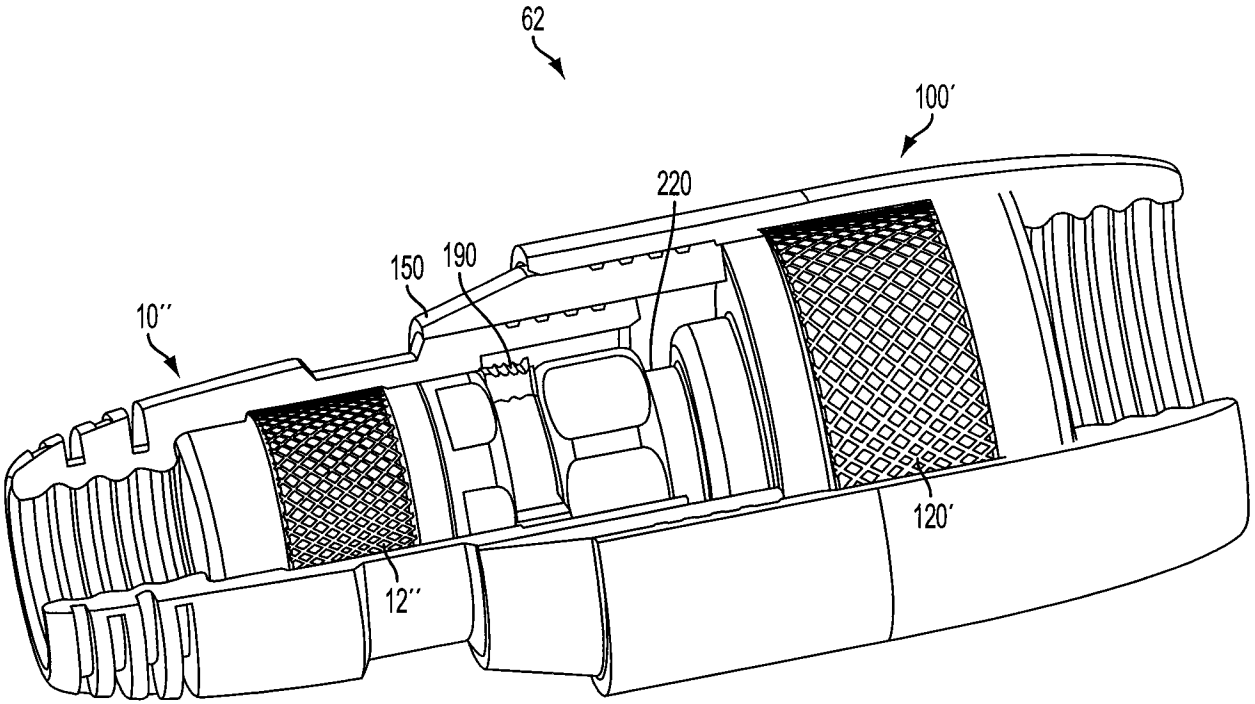

FIGS. 7C and 9 show another embodiment of adaptor 150 (hereinafter referred to as 150'). In this embodiment, adaptor 150' comprises: an elongated body composed of a hard plastic material, that extends along a longitudinal axis X-X; a first end 170; and a second end 160. The exterior surface of the adaptor includes a first region 200 that extends from first end 170 to a first shoulder 180, and which is of a serrated cross-section (and thus of continuously fluctuating diameter). In one embodiment of adaptor 150', the diameter of the exterior surface gradually decreases from a maximum diameter at shoulder 180 to a minimum diameter at second end 160. The first end 170 of adaptor 150', however, is structurally different from that of the previous embodiment of the adaptor. The elongated body of adaptor 150' defines a cavity 240 that begins at shoulder 180 and terminates at first end 170. At shoulder 180, the elongated body of the adaptor bifurcates into a larger outer circumferential flexible body 250 and a smaller inner circumferential flexible body 260, which are separated by cavity 240. Additionally, the distance between outer body 250 and inner body 260 (and thus the size of cavity 240) increases gradually from a minimum first distance at shoulder 180 to a maximum distance at first end 170.

In use, adaptor 150' in FIGS. 7C and 9 serves to fill the space left by two covers of non-interfering dimensions, as described above. The bifurcated structure and cavity of adaptor 150' allows the adaptor to fill a wider variety of gaps using a wider variety of covers. For instance, while some covers will completely encompass the outer serrated surface of adaptor 150' (see, e.g. FIG. 9), other covers will only partially encompass the outer serrated surface of the adaptor (see, e.g. FIG. 1A0), typically as a result of the underlying cable connectors. Adaptor 150' allows the serrated outer surface to adapt to both configurations. Additionally, if the inner circumference of the connector end of cover 100' is smaller than the outer circumference of adaptor 150', the cavity of the adaptor can be compressed during assembly to allow cover 100' to slide over the adaptor. Adaptor 150' is positioned into the assembled configuration depicted in FIG. 9 as described above.

Figure 12:
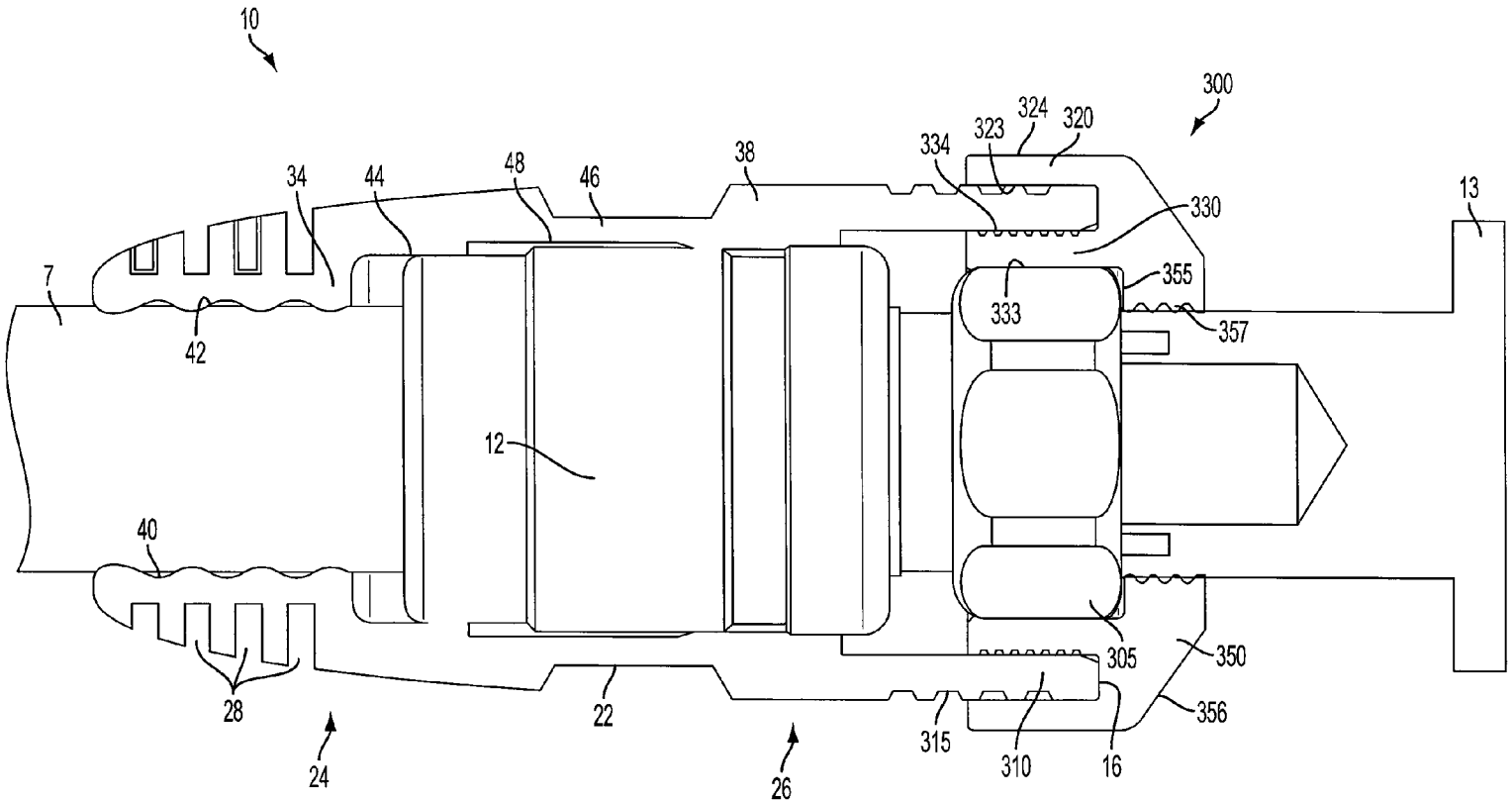
FIG. 12 depicts a cross-section view of a first embodiment of a collar sealing engaged to an embodiment of a sealing cover.

Referring still to the drawings, FIG. 12 depicts an embodiment of a collar 300. Embodiments of collar 300 may sealingly engage with the sealing cover 10 to prevent ingress of environmental elements at a location between the collar 300 and the cover 10. Sealing engaging the cover 10 may include an interference fit between more than one axial surfaces of the collar 300 that may overlap portions of the cover 10 (e.g. an exterior and interior surface of the cover 10) that can be tight enough to prevent the flow of fluids between them, yet allow a user to peel away and/or separate the collar 300 and the cover 10 to access the coupler member 305. Additionally, the cover 10 and the collar 300 may sealing engage a port, or a portion thereof, such as bulkhead 13, or an external surface of the port, and sealing engage a connector 12, or a portion thereof. For instance, the cover 10 and the collar 300 may provide a seal over the port and the connector 12 through an interference fit between the collar 300 and an external surface of a port (in a radial direction) and a portion of the connector 12, or the entire coupling member 305, in a radial direction, and between the cover 10 and the connector 12 and a portion of the coaxial cable 7, in a radial direction.

Embodiments of collar 300 may be a one-piece component comprised of an elastomeric material having a softness greater than the material comprising the sealing cover 10. For example, collar 300 may be comprised of a rubber material that exhibits a low modulus of elasticity over an extended temperature range. Embodiments of the collar may be made of a silicone rubber. Other embodiments of the collar 300 may be made of polyurethane, or similar polymer having a high yield strain and a low Young's modulus. Moreover, the collar 300 may sealingly engage an external surface of a bulkhead 13 to prevent ingress of environmental elements, which may cause degradation of the signal quality and corrosion of the coaxial cable connector 12. Embodiments of the collar 300 may also be referred to as a rubber gasket, sealing ring, and the like. The collar 300 may have a generally axial opening 303 from a first end 301 to a second end 302 of the collar 300 to fit over an equipment port, such as bulkhead 13. Those skilled in the art should appreciate that the opening 303 (i.e. internal diameter of the collar 300) may vary to accommodate different sizes of ports 13 configured to mate with different sized coaxial cable connectors.

Embodiments of collar 300 may include a base portion 350, a first sleeve portion 320, and a second sleeve portion 330, wherein the collar 300 is configured to sealingly contact and overlap multiple surfaces of an insertable sealing cover, such as cover 10. Further embodiments of collar 300 may include a base portion 350, the base portion 350 including an inner mating surface 357, a first sleeve portion 320 integrally connected to a base portion 350, and a second sleeve portion 330 integrally connected to the base portion 350, wherein a cavity 340 between the first sleeve portion 320 and the second sleeve portion 330 is configured to accept a portion 310 of the sealing cover 10, wherein the portion 310 of the sealing cover 10 disposed within the cavity 340 sealingly contacts the first sleeve portion 320 and the second sleeve portion 330. Other embodiments of collar 300 may include a base portion 350, the base portion 350 including an inner mating surface 357 configured to prevent ingress of environmental elements, a first sleeve portion 320 integrally connected to the base portion 350, wherein the first sleeve portion 320 includes an interlocking feature 360, a second sleeve portion 330 integrally connected to a base portion 350, the second sleeve portion 330 spaced a radial distance from the first sleeve portion 320, and, wherein, when a portion 310 of the sealing cover 10 is disposed between the second sleeve portion 330 and the first sleeve portion 320, the interlocking feature 360 of the first sleeve portion 320 interlocks with at least one corresponding interlocking feature 315 of the sealing cover 10 to indicate a correct sealing position.

Figure 13:
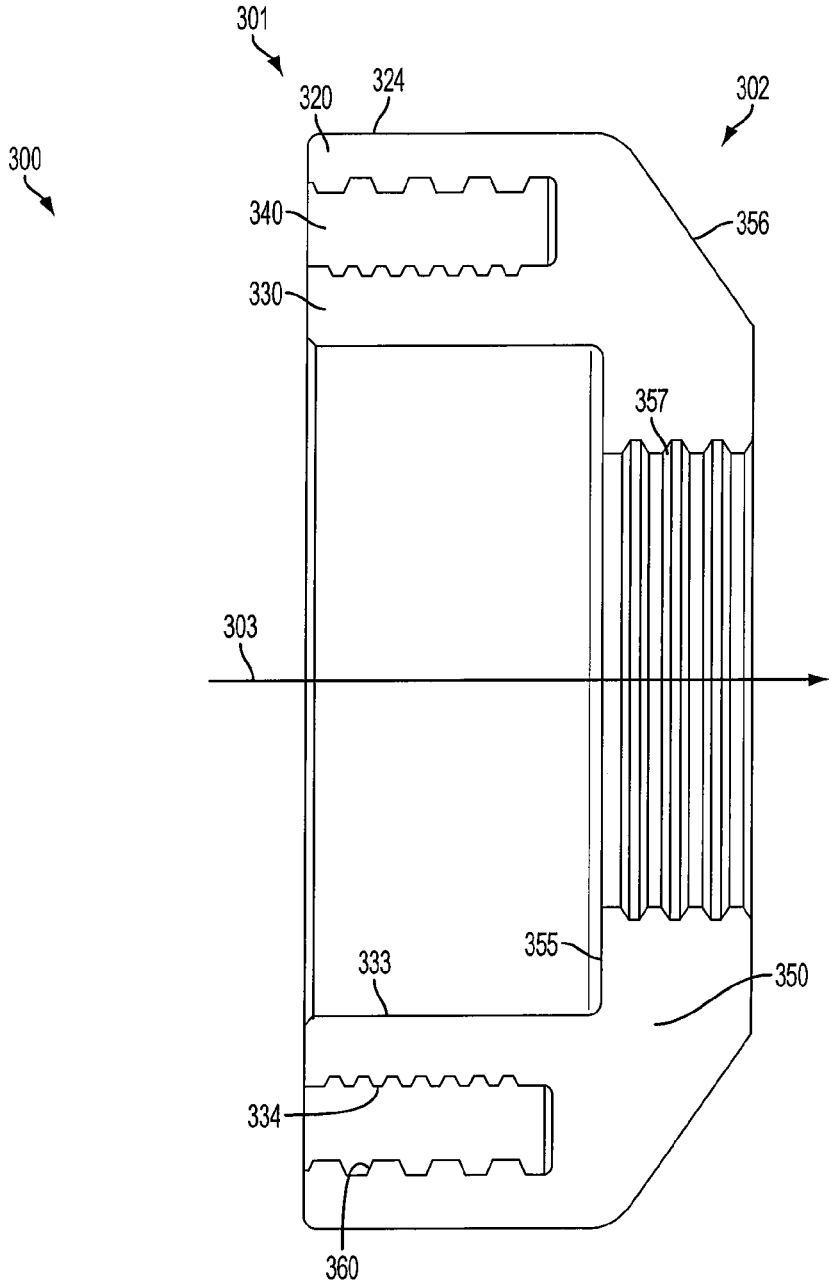
FIG. 13 depicts a cross-section view of the first embodiment of the collar.
Figure 14:
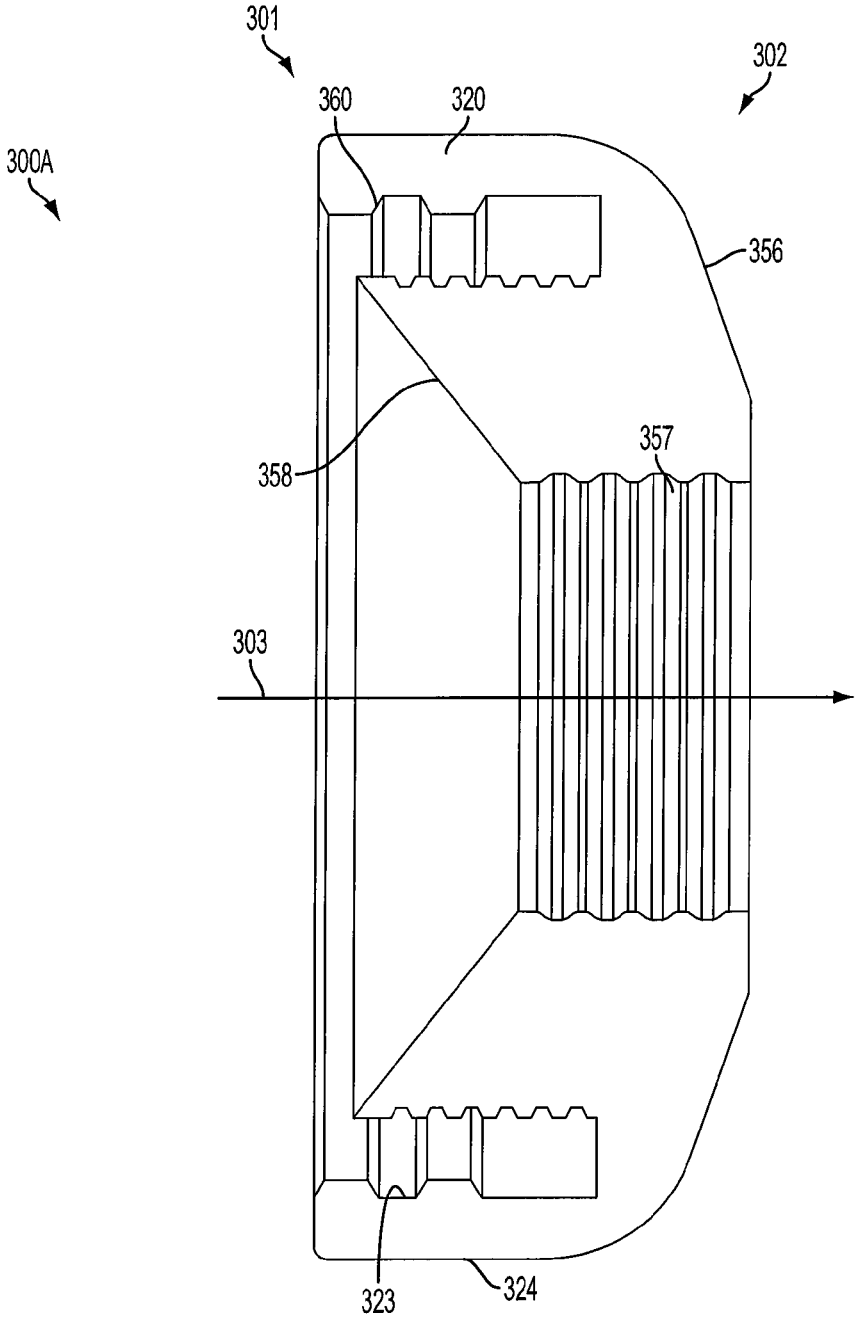
FIG. 14 depicts a cross-section view of a second embodiment of the collar.
Figure 15:
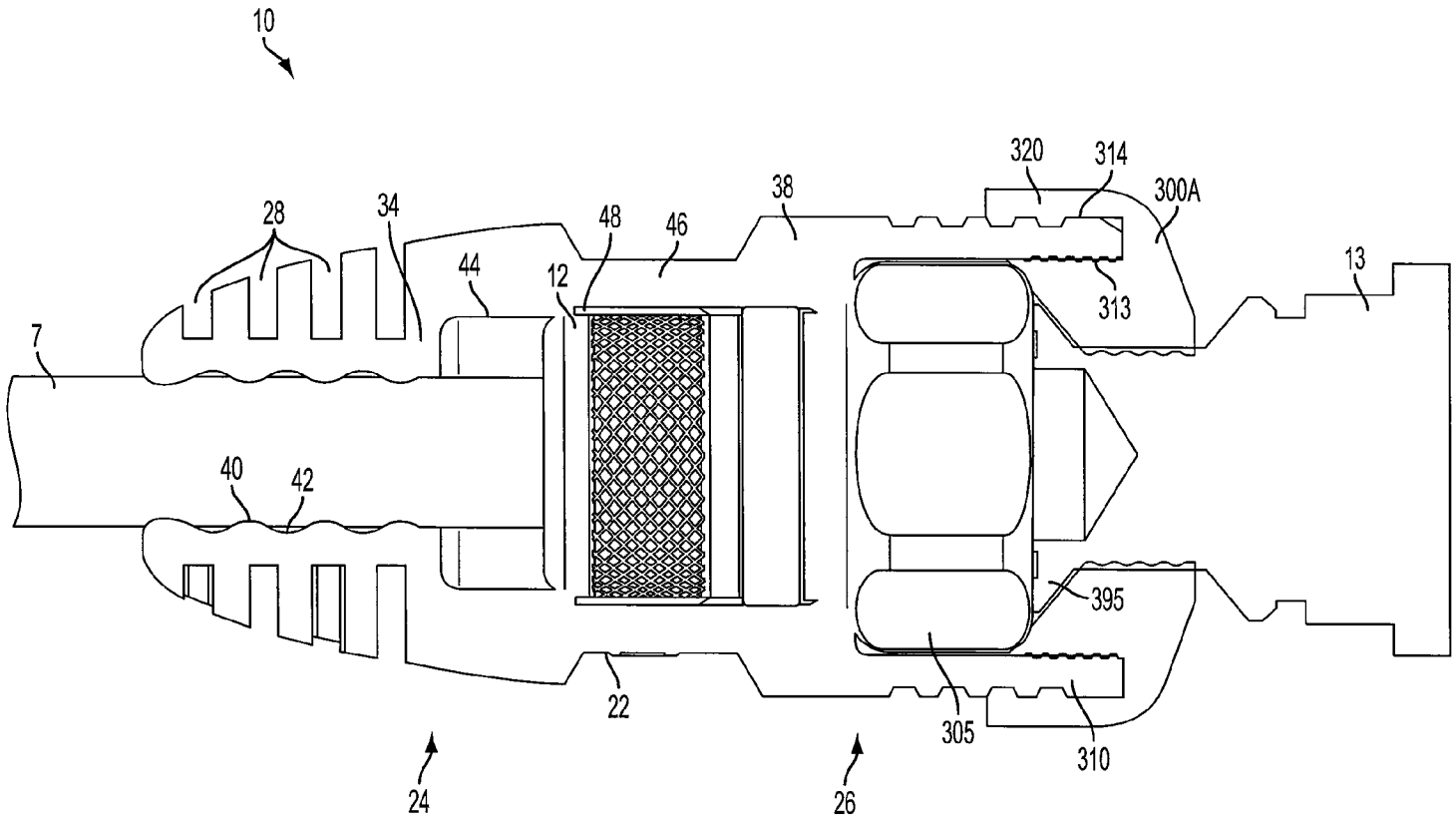
FIG. 15 depicts a cross-section view of the second embodiment of the collar sealingly engaged to an embodiment of the sealing cover.

With continued to reference to FIG. 12, and additional reference to FIG. 13, embodiments of collar 300 may include a base portion 350. Base portion 350 may be a main body of the collar 300, wherein the sleeve portions 320, 330 extend (i.e., structurally integrally extend) from the base portion 350. The base portion 350 may include an inner mating surface 357 proximate the second end 302 of the collar 300 that sealingly contacts a neck, or an external surface, of the equipment port, such as bulkhead 13. Embodiments of the inner mating surface 357 may include one or more grooves to create bands of higher pressure contact points against the port, wherein if water and moisture escape underneath the mating edge surface 57 proximate the second end 302 of the collar 300, the water/moisture may collect between the grooves and not proceed further towards connector 12. Moreover, the base portion 350 may include an internal annular lip 355. The internal annular lip 355 may be defined by an abrupt reduction in the diameter of the general opening 300 proximate the first end 301 to a diameter proximate the second end 302 of the collar. FIG. 14 depicts an alternative embodiment of collar 300A, which has an internal annular tapered surface 358. The internal annular tapered surface 358 may be defined by a gradual reduction in diameter from a diameter of the general opening 303 proximate the first end 301 to a diameter proximate the second end 302 of the collar 300. Embodiments of collar 300A that include an internal annular tapered surface 358 may be collars configured to be used with ports having an annular ramped section 395 proximate an end of the port proximate the coupling member 305, as shown in FIG. 15. Accordingly, the internal annular tapered surface 358 may engage the ramped section 395 of the port proximate a coupling member 305 (when the connector 12 is mated with the port, as well as a portion of the coupling member 305. The internal annular lip 355 may likewise engage a coupler member 305 of the connector 12 when the collar 300 is operbaly positioned. However, due to the resilient nature of the collar 300, the annular lip 355 (or annular tapered surface 358) may be in contact with the coupling member 305 of the connector 12, yet the sleeve portions 320, 330 may be further extended over the connector 12/coupler member 305 beyond their axial lengths when at rest. Embodiments of the base portion 350 may also include an external annular ramped surface 356 proximate the second end 302 of the collar 300. The external annular ramped surface 356 may include smooth, curvy or angled corners, as opposed to sharp corners/edges to facilitate removal of a (steel) core pin during manufacturing processes, such as injection molding. The annular ramped surface 356 may provide space for accessing/grabbing the collar 300 when the collar 300 is pushed up against the end of the bulkhead 13. Because the base portion 350 can completely encompass the portion 310 of the cover 10 proximate the second end of the collar 300, no environmental elements, such as contaminants, pollutants, rainwater, moisture/condensation, and other corrosion inducing substances, may seep between the collar 300 and the sealing cover 10 from the port/bulkhead 13 side.

Embodiments of collar 300 may further include a first sleeve portion 320; the first portion 320 may also be referred to as an outer sleeve portion. Embodiments of the first sleeve portion 320 may be integrally connected to the base portion 350. For instance, the first sleeve portion 320 may be comprised of the same material and structurally integrally extend from the base portion 350 in an axial or generally axial direction towards the first end 301 of the collar 300. Embodiments of the first sleeve portion 320 may include an inner surface 323 and an outer surface 324. Moreover, embodiments of the collar 300 may include a second sleeve portion 330; the second sleeve portion may also be referred to as an inner sleeve portion. Embodiments of the second sleeve portion 330 may be integrally connected to the base portion 350. For instance, the second sleeve portion 330 may be comprised of the same material and structurally integrally extend from the base portion 350 in an axial or generally axial direction towards the first end 301 of the collar 300. Embodiments of the second sleeve portion 330 may include an inner surface 333 and an outer surface 334. The first sleeve portion 320 may be separated from the second sleeve portion 330 by a radial distance to define an opening (generally axial opening) between the first sleeve portion 320 and second sleeve portion 330. The opening between the sleeve portions 320, 330 may be a cavity 340. The cavity 340 between the second sleeve portion 330 and the first sleeve portion 320 is configured to accept a portion 310 of the sealing cover 10, wherein the portion 310 of the sealing cover 310 disposed within the cavity 340 sealingly contacts the second sleeve portion 320 and the first sleeve portion 330. For example, a first overlap section between the collar 300 and the cover 10 is created when the inner surface 323 of the first sleeve portion 320 overlaps, for an axial length of the first sleeve portion 320 extending from the base portion 350, an exterior surface 314 of the sealing cover portion 310 disposed within the cavity 340 to form a seal or barrier against environmental elements. Likewise, a second overlap section between the collar 300 and the cover 10 is created when the outer surface 334 of the second sleeve portion 330 overlaps, for an axial length of the second sleeve portion 330 extending from the base portion 350, an interior surface 313 of the sealing cover portion 310 disposed within the cavity 340 to form a seal or barrier against environmental elements. Embodiments of the cavity 340 may be an opening, a space, an annular opening, annular cavity, a void, and the like. The cavity 340 may be open at the first end 301 of the collar 300, and may axially extend until the base portion 350. The axial length of overlap between the multiple surfaces of the collar 300 and the cover 10 may depend on the axial length of the cavity 340. In other words, the further the sleeve portions 320, 330 extend from the base portion 350, the longer the axial length of surface overlap can exist between the collar 300 and the cover 10.

Referring back to FIG. 13, embodiments of collar 300 may include an interlocking feature 360 to positively interlock with the cover 10 and to indicate a correct sealing position to a user. In most embodiments, the first sleeve portion 320 of the collar 300 may include the interlocking feature 360. For example, the inner surface 323 of the first sleeve portion 320 may include one or more interlocking surface features comprising the interlocking feature 360. Embodiments of the interlocking feature 360 may be one or more grooves, teeth, ramped grooves, ribs, and the like, the extend around or partially around the inner surface 323 of the first sleeve portion 320. Embodiments of sealing cover 10 may include a corresponding interlocking feature 315 on an exterior surface 314 of the cover 10 proximate the portion 310 of the cover 310 disposed within the cavity 340, as shown in FIG. 12. The corresponding interlocking feature 315 may be one or more grooves, ramped grooves, teeth, ribs, and the like, that can interlock with the interlocking feature(s) 360 of the collar 300, as shown in FIG. 15. For instance, when a portion 310 of the sealing cover 10 is disposed between the second sleeve portion 330 and the first sleeve portion 320 (i.e. within cavity 340), the interlocking feature 360 of the first sleeve portion 320 may interlock with at least one corresponding interlocking feature 315 of the sealing cover 10 to indicate a correct sealing position. A correct sealing position may be when the interlocking feature(s) 360 snugly and correctly match/fit within the corresponding interlocking feature(s) 315 of the cover 10. In other words, a correct sealing position between the collar 300 and the cover 10 according to the interlocking features 360, 315 may occur when the user pulls, stretches, etc. the collar 300 toward the connector 12 until the interlocking features 360, 315 snap into place. The end 16 of the portion 310 need not be fully inserted into cavity 340 such that the end 16 of the portion 310 of the cover 10 contacts the base portion 350 to achieve a correct sealing position. In other words, an air pocket may exist between the portion 310 of the cover 10 and the base portion 350 when the interlocking features 360 snap into place with the corresponding interlocking features 315. However, if one or more of the interlocking features 360 of the first sleeve portion 320 does not snugly and correctly match/fit within the corresponding interlocking features 315, it may be visible to the user, alerting the user that he or she must further pull/extend, stretch, etc., the collar 300 toward the connector 12 into further engagement with the cover 10. Accordingly, the interlocking feature 360 of the collar 300 may provide increased sealing and interference engagement with the cover 10, but may also act as an indicator to the user to ensure the collar 300 is in the correct sealing position.

Figure 16:
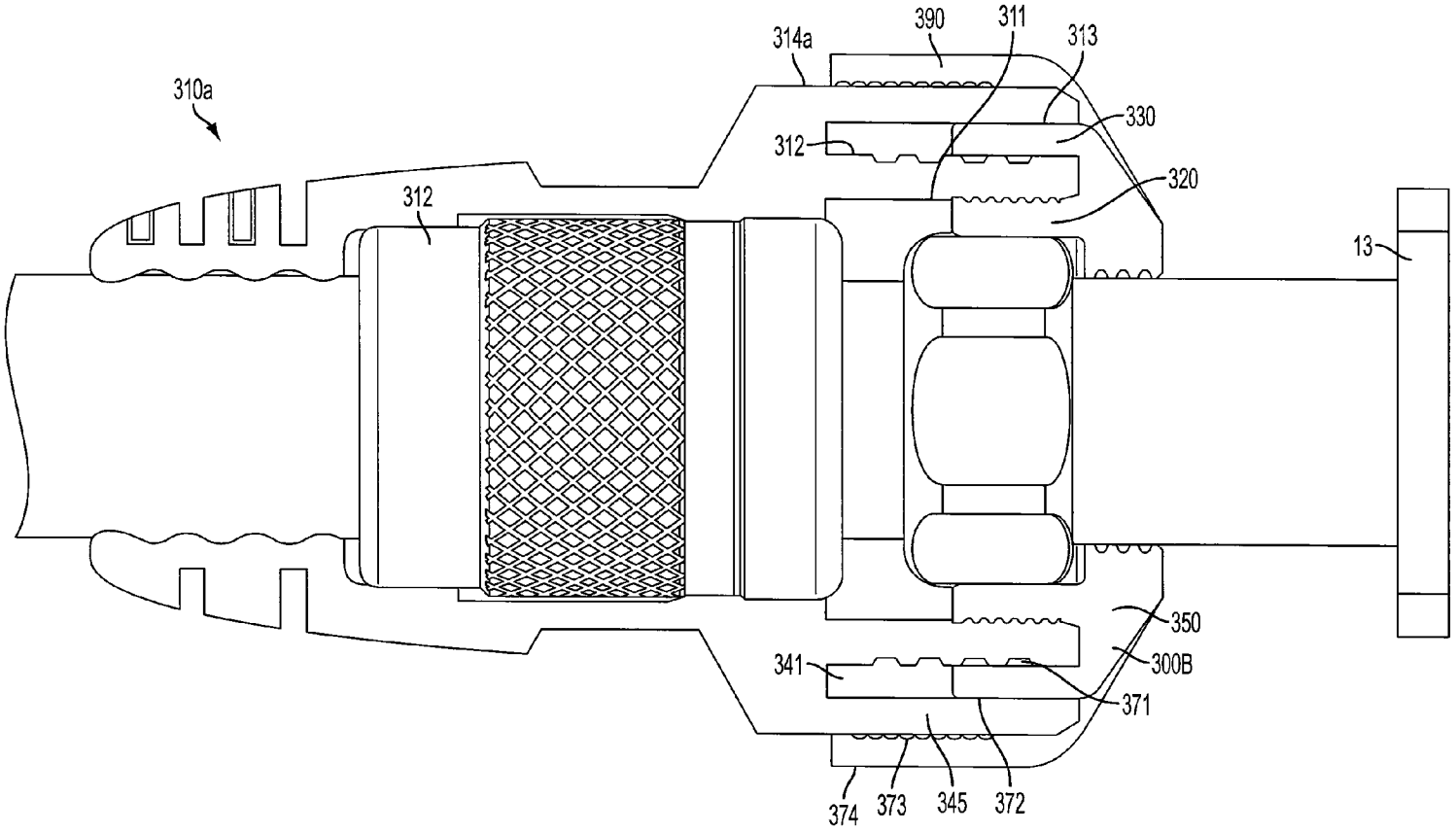
FIG. 16 depicts cross-section view of a third embodiment of the collar sealing engaged to an embodiment of the sealing cover.

With reference now to FIG. 16, embodiments of collar 300B may include an additional sleeve portion 390, which increases the amount of overlapped section between the collar 300B and the sealing cover 310. Embodiments of the sealing cover 310*a* may share the same or substantially the same structure and function as cover 10; however, sealing cover 310*a* may include an outer annular member 345, which is radially separated from the exterior surface 314 of the sealing cover portion 310 disposed within cavity 340. The radial separation between the outer annular member 345 and the exterior surface 314 of the sealing cover portion 310 disposed within cavity 340 may define a second cavity 341, wherein the additional sleeve portion 390 may enter and sealing contact the cover 310*a* to form another overlapped section. Furthermore, embodiments of collar 300B for sealingly engaging a sealing cover 310*a* may include a first axial surface 371 of the collar 300B configured to overlap a first surface 311 of the sealing cover 310, a second axial surface 372 of the collar 300B configured to overlap a second surface 312 of the sealing cover 310*a*, wherein the collar 300B has a general axial opening 303 from a first end 301 to a second end 302 of the collar 300B to fit over an equipment port. Embodiments of collar 300B may further include a third axial surface 373 of the collar configured to overlap a third surface 313 of the sealing cover 310*a*, and a fourth axial surface 374 of the collar 300B configured to overlap a fourth surface 314*a* of the sealing cover 310*a*. The second axial surface 372 may include at least one ramped groove 360 that corresponds to at least one ramped groove 315 on a sealing cover 310*a* to interlock the components and indicate a correct sealing position.

Figure 17:
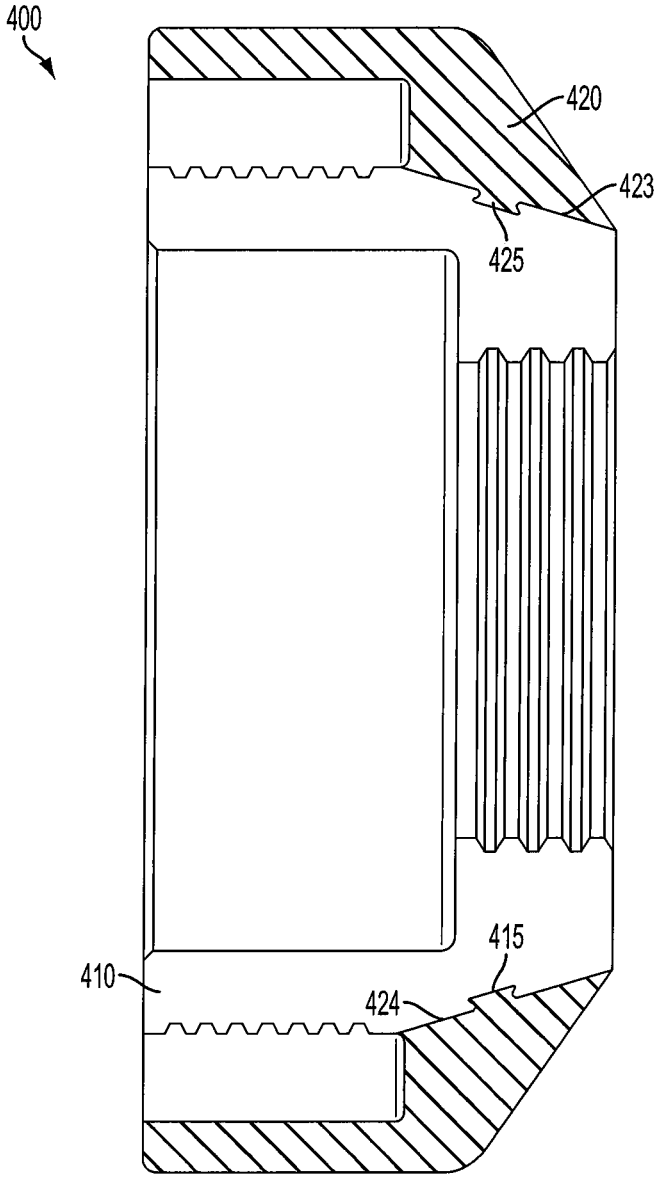
FIG. 17 depicts a perspective partial cut-away view of an embodiment of a collar in a splice connection.

Continuing to refer to the drawings, FIG. 17 depicts an embodiment of collar 400. Embodiments of collar 400 may share the same or substantially the same structure and function as collar 300, described supra. However, embodiments of collar 400 may be a dual piece collar, wherein a second portion 420 sealingly attaches to the first portion 410. Sealing attaching may include an outer mating edge 414 of the first portion 410 physically contacting, for example, uniformly touching around the collar 400, a inner mating edge 423 of the second portion 420 to prevent entry of environmental elements, such as rainwater. The first portion 410 may include a groove 415 proximate the outer mating edge 414 configured to accept a key feature 425 of the second portion 420. Alternatively, the first portion 410 may include a key feature and the second portion 420 may include a groove to sealingly attach the two components. Moreover, the first portion 410 can be comprised of a soft rubber, which may be allow the first portion 410 to make it over the threads or the coupling element 452 on the port, while the second portion 420 may comprised of a harder elastomeric material which can help contract the collar 400 onto the port and/or connector 412. Manufacture of embodiments 400 could be done using a dual-shot mold or over-molding, or other suitable molding processes known to those having skill in the requisite art.

Figure 18:
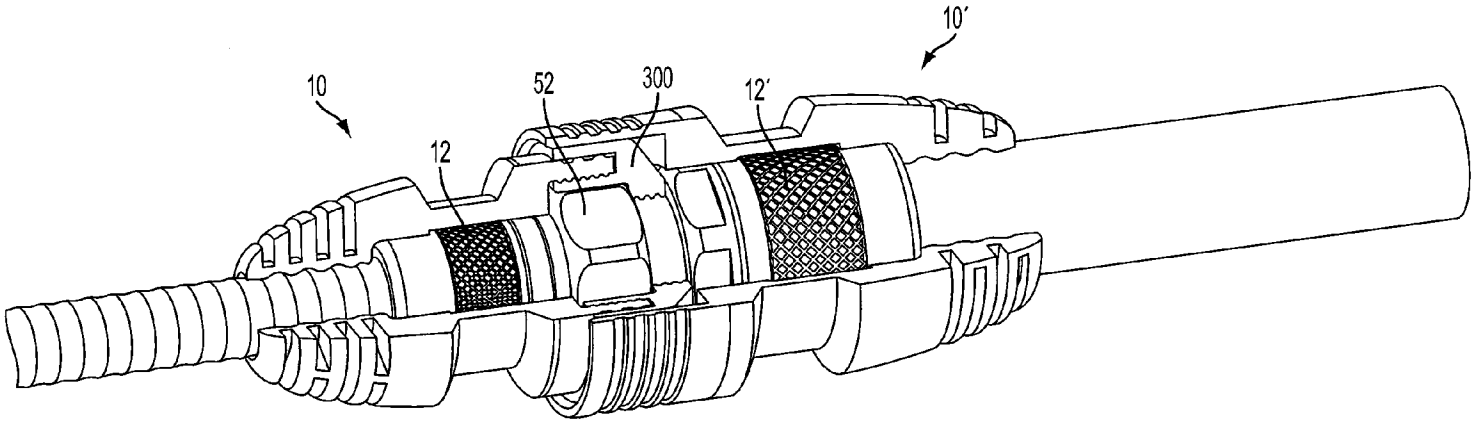
FIG. 18 depicts a perspective partial cut-away view of an embodiment of a system for covering a pair of connectors.

Referring to FIG. 18, although embodiments of collar 300, 300A, 300B may be placed in covering relation to connectors 12, 12' and cover 10 that terminate in a bulkhead 13, a system for covering a pair of connectors that are used to splice together two differently sized cables and cable connectors may also employ the use of a collar, such as collar 300, 300A, 300B. For example, cover 10 may cover a first cable connector 12, and cover 10' may cover a second connector 10', wherein the first connector 10 and the second connector 10' are at least one of the same size or a different size. Collar 300 may be inserted between cover 10 and cover 10' to improve the overlap length between the collar 300 and the covers 10, 10.'

With reference to FIGS. 1-18, a method of sealing a coaxial cable connection, may comprise the following steps of providing a collar 300, 300A, 300B including a base portion 350, the base portion 350 including an inner mating surface 357, a first sleeve portion 320 integrally connected to a base portion 350, and an second sleeve portion 330 integrally connected to the base portion 350, wherein a distance between the first sleeve portion 320 and the second sleeve portion 330 define a cavity 340, disposing the collar 300, 300A, 300B over an equipment port and at least one coaxial cable connector component, wherein the inner mating surface 357 of the base portion 350 provides a seal between the collar 300, 300A, 300B and the equipment port, and inserting an end 16 of a sealing cover 10, 310 within the cavity 340 of the collar 300, 300A, 300B to prevent the ingress of environmental elements. The method may further include the steps of disposing a plurality of grooves 360*a* on an inner surface 323 of the first sleeve portion 320 to interlock the collar 300, 300A, 300B and the sealing cover 10, 310, and after insertion, pulling at least one of the collar 300, 300A, 300B and the sealing cover 10, 310*a* until the plurality of grooves 360 on an inner surface 323 of the first sleeve portion 320 snap into place with corresponding grooves 315 located on an outer surface of the sealing cover 10, 310*a*.

Although the present invention has been described in connection with a preferred embodiment, it should be understood that modifications, alterations, and additions can be made to the invention without departing from the scope of the invention as defined by the claims.

The claims are as follows:

1. A collar configured to sealingly engage a sealing cover, the collar and the sealing cover configured to establish a seal against environmental elements, the collar comprising:

a base portion, the base portion including an inner mating surface defining a first cavity, the first cavity configured to receive a port portion of an equipment port;

a first sleeve portion integrally connected to the base portion, the first sleeve portion defining a second cavity, the second cavity configured to receive a sealing cover portion of a sealing cover, the sealing cover configured to receive a cable connector; and a second sleeve portion integrally connected to the base portion, the second sleeve portion defining a third cavity that is at least partially surrounded by the second cavity, the third cavity configured to receive a coupler member portion of a coupler member of the cable connector, wherein, when the sealing cover is covering the cable connector and when the collar and the sealing cover are attached to the equipment port, the collar is configured to establish an environmental seal to block environmental elements from reaching the cable connector and the coupler member.

2. The collar of claim 1, wherein the sealing cover portion of the sealing cover contacts an inner surface of the first sleeve portion to create a first overlap section, and contacts an outer surface of the second sleeve portion to create a second overlap section.

3. The collar of claim 1, wherein the inner mating surface of the base portion sealingly contacts a neck of the equipment port.

4. The collar of claim 1, wherein the inner mating surface of the base portion includes a plurality of grooves.

5. The collar of claim 1, wherein the second and third cavities are radially distanced apart from each other.

6. The collar of claim 1, wherein the collar is a one-piece component comprised of an elastomeric material having a softness greater than the material comprising the sealing cover.

7. The collar of claim 5, wherein the collar is comprised of silicone rubber.

8. The collar of claim 5, wherein the base portion includes at least one of an internal annular lip and an internal annular tapered surface, and an external annular ramped surface.

9. The collar of claim 1, wherein the first sleeve portion includes an interlocking feature configured to interact with a corresponding locking feature of the sealing cover.

10. A collar for sealing a coaxial cable connection, the collar comprising:

a first end configured to face an equipment port, the first end including an inner mating surface configured to receive a neck portion of the equipment port; and a second end configured to face a connector cover that is attached to the equipment port, wherein the connector cover is configured to partially cover a coaxial cable connector having a coupler, the second end configured to receive and cover a coupler portion of the coupler when the coupler portion is partially uncovered by the connector cover, the second end further configured to receive a cover portion of the connector cover, wherein the collar is configured to surround the neck portion, the coupler portion and the cover portion to environmentally seal a coaxial cable connection.

11. The collar of claim 10, wherein the second end has a plurality of grooves on an inner surface of the second end to interlock the collar and the connector cover.

12. The collar of claim 10, wherein the second end defines an inner cavity configured to receive the coupler portion, and the second end defines an outer cavity separated from the inner cavity by a surface, the outer cavity surrounding at least part of the inner cavity, the outer cavity configured to receive the cover portion, the first end defining a first end cavity spaced axially apart from the inner cavity, the first end cavity configured to receive the neck portion of the equipment port.

13. A collar comprising:

a first body portion comprising a first end, the first end configured to face toward an equipment port when the collar is attached to the equipment port, the first body portion also comprising a port engaging surface, the port engaging surface defining a first opening configured to receive a port portion of the equipment port; and a second body portion comprising a second end configured to face toward a connector cover when the collar is attached to the connector cover, the second body portion also comprising a coupler receiving surface that defines a second opening, the second opening configured to receive a coupler portion of a coupler of a cable connector, the second body portion comprising a connector cover receiving surface that defines a third opening, the third opening configured to receive a connector cover portion of the connector cover, wherein the collar is configured so that, when the collar is attached to the port portion, the port engaging surface is configured to sealingly engage the port portion, the coupler receiving surface is configured to surround the coupler portion, and the connector cover receiving surface is configured to sealingly engage the connector cover portion so that the cable connector and the coupler are environmentally sealed when attached to the equipment port.

14. The collar of claim 13, wherein the first, second and third openings extend along an axis and comprise three different diameters, the first opening being spaced apart from the second opening along the axis.

15. The collar of claim 13, wherein the port engaging surface comprises a mating structure configured to mate with an external surface of the port portion.

16. The collar of claim 13, wherein the connector cover receiving surface comprises a mating structured configured to mate with a surface of the connector cover.

17. The collar of claim 13, wherein the coupler receiving surface is configured to sealingly engage the coupler portion.

* * * * *